US006241462B1

(12) United States Patent
Wannasuphoprasit et al.

(10) Patent No.: US 6,241,462 B1
(45) Date of Patent: Jun. 5, 2001

(54) METHOD AND APPARATUS FOR A HIGH-PERFORMANCE HOIST

(75) Inventors: Witaya Wannasuphoprasit; J. Edward Colgate, both of Evanston; Dave Meer, Skokie; Michael Peshkin, Evanston, all of IL (US)

(73) Assignee: Collaborative Motion Control, Inc., Evanston, IL (US)

( * ) Notice: Subject to any disclaimer, the term of this patent is extended or adjusted under 35 U.S.C. 154(b) by 0 days.

(21) Appl. No.: 09/357,205

(22) Filed: Jul. 20, 1999

(51) Int. Cl.[7] ..... B66D 1/48
(52) U.S. Cl. ..... 414/800; 212/283; 414/21
(58) Field of Search ..... 212/278; 254/270; 414/21, 800

(56) References Cited

U.S. PATENT DOCUMENTS

| | | | | |
|---|---|---|---|---|
| 3,286,989 | | 11/1966 | Bangerter et al. . | |
| 3,325,148 | | 6/1967 | Powell . | |
| 3,384,350 | | 5/1968 | Powell . | |
| 3,421,737 | | 1/1969 | Ubling . | |
| 3,654,415 | | 4/1972 | Hawkins et al. . | |
| 3,755,725 | | 8/1973 | Cordes . | |
| 3,772,579 | | 11/1973 | Stone et al. . | |
| 3,841,605 | * | 10/1974 | Joraku et al. | 212/278 |
| 3,863,772 | | 2/1975 | Schwartz . | |
| 3,916,279 | | 10/1975 | Kawano et al. . | |
| 3,945,612 | | 3/1976 | Motoda | 254/173 R |
| 3,982,733 | | 9/1976 | Orme . | |
| 4,334,217 | | 6/1982 | Nield et al. . | |
| 4,338,565 | | 7/1982 | Hall . | |
| 4,636,962 | | 1/1987 | Broyden et al. . | |
| 4,646,087 | | 2/1987 | Schumann . | |
| 4,690,380 | | 9/1987 | Niskin et al. . | |
| 4,807,767 | | 2/1989 | Kornely . | |
| 4,875,530 | * | 10/1989 | Frink et al. | 254/270 X |
| 4,917,360 | | 4/1990 | Kojima . | |
| 5,152,183 | | 10/1992 | Munzebrock . | |
| 5,261,026 | | 11/1993 | Tomaru et al. | 388/847 |
| 5,350,075 | | 9/1994 | Kahlman . | |
| 5,491,549 | | 2/1996 | Wichner et al. . | |
| 5,522,581 | | 6/1996 | Kulhavy . | |
| 5,581,180 | | 12/1996 | Ito et al. . | |
| 5,729,339 | | 3/1998 | Park . | |
| 5,764,066 | | 6/1998 | Novak et al. . | |
| 5,785,191 | | 7/1998 | Feddema . | |
| 5,813,124 | | 9/1998 | Freltag . | |
| 5,848,781 | | 12/1998 | Kulhavy et al. . | |
| 5,850,928 | | 12/1998 | Kahlman et al. . | |
| 5,865,426 | | 2/1999 | Kazerooni . | |

FOREIGN PATENT DOCUMENTS

| | | | | |
|---|---|---|---|---|
| 724527 | * | 12/1965 | (CA) | 414/21 |
| 0 262 134 B1 | | 4/1988 | (EP) . | |
| 0 471 026 B1 | | 2/1992 | (EP) . | |
| 0 733 579 A1 | | 9/1996 | (EP) . | |
| 0 839 614 A1 | | 5/1998 | (EP) . | |

* cited by examiner

*Primary Examiner*—Janice L. Krizek
(74) *Attorney, Agent, or Firm*—McDonnell Boehnen Hulbert & Berghoff

(57) ABSTRACT

A mechanical apparatus and method for a high performance hoist for raising and lowering a load, and control apparatus and method for controlling the hoist such that its operation is responsive and intuitive for a human operator. The mechanical apparatus provides a reel for winding a cable, a ball-screw for translating the reel, and an encoder on the reel with which the height of the payload may be monitored. Also disclosed is an operator's handle comprising a movable sleeve with a damper as well as a spring to return it to its null position. The control apparatus and method provides for a handle-nulling mode in which the payload height is servo-controlled to follow the displacement of the operator's hand grasping the handle. The control apparatus further provides a float-mode in which the payload height is responsive to the operator's forces applied directly to the payload. Further, a payload mass estimation system is provided such that the mass of the payload can be determined without waiting for a period of time to allow the payload to settle. In addition, a mode-switching algorithm for transparent switching among different control modes is also disclosed.

7 Claims, 19 Drawing Sheets

METHOD AND APPARATUS FOR A HIGH-PERFORMANCE HOIST

FIELD OF INVENTION

The present invention relates to the design and use of hoists to raise and lower a payload. More particularly, the present invention is directed to mechanical design as well as control system design, and methods to enable more intuitive control of a hoist device to move and manipulate the payload.

BACKGROUND OF THE INVENTION

A simple hoist consists of a motor which raises and lowers a payload, typically under the control of an operator. The usual control for operating a hoist is a pushbutton pendant that allows an operator to control the hoist to raise and lower the payload up or down, sometimes with variable speed, and typically quite slowly (a few inches per second). For large payloads, such as a 300 pound engine block, an operator may be willing to live with the limits and restrictions on movement imposed by such a control, such as that the payload can only be moved up or down and only at a choice of two speeds.

For lighter payloads, however, agility of the hoist becomes of prime importance. If the load is a small glue gun or an automobile battery, an operator will not be so tolerant of inconvenient restrictions on movement. In repetitive motion environments, such as in a manufacturing assembly production line, even small loads can cause ergonomic problems due to long and repeated operator exposure to repetitive movements. Thus, it is not uncommon to use hoists or balancers for loads that are in fact easily within the range of human strength to lift unassisted in order to avoid fatigue or repetitive motion injuries of the operator. However, the operator's frustration with a hoist lacking the appropriate agility for the particular payload and job may cause the operator not to use the hoist and to eventually be injured. Even with larger loads, while operators will tolerate slow and clumsy control of payloads that they cannot lift unassisted, there are still great productivity gains to be had if a load can be more easily and "transparently" lifted by a really agile hoist.

The industry's response to the need for an agile, light-duty hoist is the balancer, which is a species of light hoist, although the terms hoist and balancer are not always clearly distinguished. The balancer provides a constant upward force on the payload equal to the payload's weight, thus "balancing" the payload against the force of gravity. The payload is effectively weightless and any additional forces applied by the operator to the payload will cause the payload to move up or down according to the applied force.

Generally, there are two popular kinds of balancers, spring balancers commonly used for small loads and pneumatic balancers often used for larger loads. Both types of balancers suffer from the problem that their upward force must be adjusted to match the weight of the expected payload. For balancing a tool, a "constant upward force" balancer is fine. But if the expected payload varies over the course of a task, for instance if the payload is picked up and later put down, the upward force that the balancer provides must be varied with the weight of the payload.

Typically, upward force is adjusted by adjusting the spring tension on the spring balancers, or by adjusting the compressed air pressure supplied to pneumatic balancers. For the right application, spring balancers are quite agile and responsive. They work well for counterbalancing a fixed payload such as a tool, however, they do not work so well for a varying payload because they cannot be easily adjusted "on the fly" to adjust for the varying load. Pneumatic balancers can be provided with two air pressure regulators with a pneumatic relay to switch between them, so that the balancer's upward force can be varied depending upon the task phase. Though pneumatic balancers can be "multiply tuned" for a load that changes during the course of a task, this adds significant complexity requiring multiple air pressure regulators and pneumatic relays, all of which require maintenance and adjustment.

Pneumatic balancers have a further problem in that they tend to have a broad "dead-band" in that a substantial amount of friction must be overcome to initiate the payload moving up or down. For instance, when the operator releases a load suspended by a balancer, it should not move the payload up or down. Of course, the upward force of the balancer and the force of gravity on the load typically won't always be perfectly matched which may result in drift of the payload up or down. Friction in the mechanism of the balancer may thus be helpful in preventing any drift or motion of the payload in this situation. In this sense, friction (or a simulacrum of it) is useful in preventing drift of the payload up or down. However, the greater the friction, the greater will be the "dead-band" or the amount of force the operator must apply to the payload to overcome the friction of the hoist and get the load moving.

In practice, spring balancers have little friction inherently. Pneumatic balancers tend to have too much friction and the resulting dead-band is broader than one would like. Note that the conventional hoists discussed earlier don't need any of the "tuning" that balancers need. Hoists move up or down as commanded by the operator control, regardless of the payload's presence or absence. However hoists don't have the agility of balancers, and they cannot be intuitively moved up or down by pushing on the payload itself. Instead, the operator must actuate switches to move the load up or down.

Electric motors have also been used in balancers to provide the necessary upward force to move the weight of the payload. By controlling the motor current, the motor's output torque can be controlled, which is converted to upward force by a reel which winds the cable from which the load is suspended. A control system for such a balancer can switch among different currents to control the motor to provide the appropriate amount of torque for different loads. Prior art hoist control methods enable the operator to manually switch between different potentiometer settings to control the current supplied to the motor, or provide a load cell to determine the weight of the load and automatically select between potentiometer settings to provide the proper counterbalance for the payload. Still needed, however, is a more effective way to control the adjustments to compensate for the weight of the payload. Efficient selection and use of motors is another issue with electric motor hoists and balancers. Generally it is desirable to use the smallest possible motor with enough power (power being the product of maximum speed and maximum torque) or more importantly, the smallest motor with enough torque for the largest expected payload. Unfortunately, electric motors tend to have more maximum speed than necessary and not enough torque to raise a payload at the relatively low speeds that a hoist typically moves a payload. To change torque and speed, a transmission is used which increases maximum torque by a factor of T and decreases speed by the same factor. The factor T is called the transmission ratio. Increasing T allows smaller, more cost effective motors to be used to move a payload.

Increasing T, however, also increases the friction of the hoist system as experienced from the load side. For a balancer friction can be a problem because the greater the friction, the more force must be applied by the operator to the load in order to overcome friction and cause the load to move. Depending on the quality of the transmission, beyond a certain value of T, the friction from the load side becomes essentially infinite: no matter how much force is applied to the output of the transmission back into the motor, the motor cannot be caused to turn. Friction in the system, as magnified by the transmission thus contributes to the width of the "dead-band" of the balancer or the amount of operator force that must be applied to the payload in order for it to move.

Needed is a lift assist device that addresses these issues with conventional hoists and balancers, and allows the use of more efficiently sized motors that can take advantage of larger transmission ratios. Further, it may have both a sensitive and responsive handle improving on the performance of hoists, and also a low dead-band "float-mode" improving on the performance of balancers.

SUMMARY OF THE INVENTION

In accordance with preferred embodiments of the present invention, some of the problems associated with using manual lift assist devices are addressed and overcome.

According to the embodiments disclosed herein, a more agile lift assist device or hoist capable of being more intuitively and responsively operated is presented. Characteristics that contribute to a sense of agility may include one or more of the following characteristics (1) a greater speed capability than hoists usually provide, (2) that the operator may apply up and down forces to a sensitive handle to command up and down motion of the payload rather than requiring the operation of switches, (3) a proportionality of response, i.e., the larger the force the operator applies, the faster the load is moved, (4) enabling the operator to apply up/down forces directly to the payload ("float mode"), and not only to a collar or handle or other interface device (5) that the hoist not only allow a high maximum velocity, but also provide a high maximum acceleration, so that the load's response to operator commands does not feel sluggish, (6) reducing the threshold force or "dead-band" that must be overcome in float mode to initiate the payload moving up or down.

According to an aspect of the invention, a highly responsive handle control mode allows the operator to control the hoist to manipulate the payload through the up or down control of a handle control device referenced to the payload. Through the handle control mode, the operator raises or lowers the handle and the hoist motor is accordingly servo-controlled to raise and lower the payload in response to the displacement of the handle.

According to yet another aspect of the invention, a payload mass estimation technique allows the mass of the payload to be ascertained excluding any apparent mass due to acceleration of payload.

In accordance with yet another aspect of the invention, a payload float mode is provided to allow the operator to apply forces directly to the payload in order to move the payload in the desired direction. The float mode controller moves the hoist in a manner that is responsive and proportional to the operator's applied force.

According to another aspect of the invention, a hoist with a narrow dead-band in float mode can also be achieved without the use of extravagant hoist motors. More cost effective motors can be used to implement a hoist with the desired payload capability.

Still another aspect of the invention provides a controller which can be used with a hoist system having a wide range of transmission ratios from motor revolutions to payload motion. To enable a hoist controller capable of operating in several modes, another aspect of the invention provides a method of transitioning between a number of different hoist operation modes.

According to yet other aspects of the invention, a rotationally driven reel, driven by an electric motor, with a ball-screw feed mechanism is utilized so that the exit-point of a helically-wrapped cable from the hoist does not wander as the cable is paid out. According to this embodiment, an electric rotary actuator is used and the ball-screw need not be rugged. The hoist may use a geared transmission to actuate the reel rotationally. A ball screw is used only as a feed mechanism, and the ball screw is thus not involved in the high power necessary to move the load up and down. According to another aspect of the invention, an absolute rotational encoder attached to the reel monitors the load height.

In still another embodiment, a felt brake annulus is used to prevent damage to the ball screw if the reel should travel to the extreme end of the ball-screw. It is the rotation of the reel, rather than its axial translation, that is primarily obstructed by the brake.

According to another aspect of the invention, a damper is used as well as a return spring in the handle. The damper gives the handle a pleasing feel and increases the stability of feedback control systems that may be applied to the hoist. An emergency-stop switch ("slap cap") may also be integrated with the top of the operator's control handle.

The aspects of the present invention provide many advantages in providing an hoist that is agile and pleasing for an operator to use. The hoist allows both a handle mode and a float mode. The handle mode is highly responsive, allowing quick and accurate payload motion in response to relatively insignificant efforts on the part of the operator. The float mode allows the operator to apply forces directly to the payload itself, without specifically grasping the handle. Float mode is especially desirable in situations when the operator needs to manipulate the payload manually in other degrees of freedom, in addition to having the hoist's assistance in the vertical direction. In this situation he or she may not wish to restrict one hand to necessarily grasp a handle.

The handle mode is highly responsive and intuitive: by virtue of the handle-nulling controller to be described, if the operator wishes the payload to rise by a small amount $\Delta z$ he simply lifts the handle by that amount $\Delta z$ and the payload quickly follows. This is an advantage over the handle mode of prior art high performance hoists, in which the operator cannot impose a desired displacement on the handle because prior art handles detect force, and are thus stiff and less responsive.

The float mode is highly responsive and intuitive because it requires only a narrow dead-band, and only small forces from the operator. In an exemplary embodiment, small forces applied by the operator can be distinguished by the controller from the payload's weight and from its inertial forces when accelerating, and thus the hoist can respond to small operator forces without an annoying dead-band. Further, in an exemplary embodiment the small dead-band does not depend on having low-friction inherently in the hoist mechanism. Not requiring low friction in the system makes possible the more efficient use of motors and the use of higher transmission ratios, both of which offer considerable cost savings.

Another advantage is that the handle mode and float mode are available at once in a single hoist, with transparent switching between different hoist operation modes and features, as made possible by the mode switching algorithm described below.

Another advantage is that the mass estimation algorithm operates accurately even when the payload is moving or accelerating. This makes it possible to determine the payload's mass, as a scale might, without requiring a settling time.

Further, the embodiments of the mechanical aspects of the hoist also provide many advantages. The dashpot in the handle provides damping and improves the stability of the control system against unwanted oscillations. A more responsive control system is thus possible without incurring oscillations. The integration of the slap-cap emergency stop switch into the operator's handle also makes it possible for the operator to quickly locate the switch in any circumstance.

Another advantage is the use of a light duty ball screw, since its function is used only to translate the reel rather than to cause it to rotate as in prior art. The ball screw serves to move the reel such that the exit point of the cable from the helical track on the reel occurs always at the same point relative to the hoist body. Thus the cable and the payload suspended from it does not wander as the payload is moved up and down.

Another advantage is the use of a felt annulus as a brake to prevent further motion of the reel if its motion exceeds the normal limits for some reason. Further, the compressed felt annulus produces a braking torque on the reel which contributes more to its stopping than does the linear collision force.

In addition, the multi-turns potentiometer enables measuring the absolute angular displacement of the reel over its many turns, thus making possible an absolute measurement of payload height without need of an index.

The invention is not limited to the illustrative described embodiments. The foregoing and other features and advantages of a preferred embodiment of the present invention will be more readily apparent from the following detailed description, which proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Figure 1:
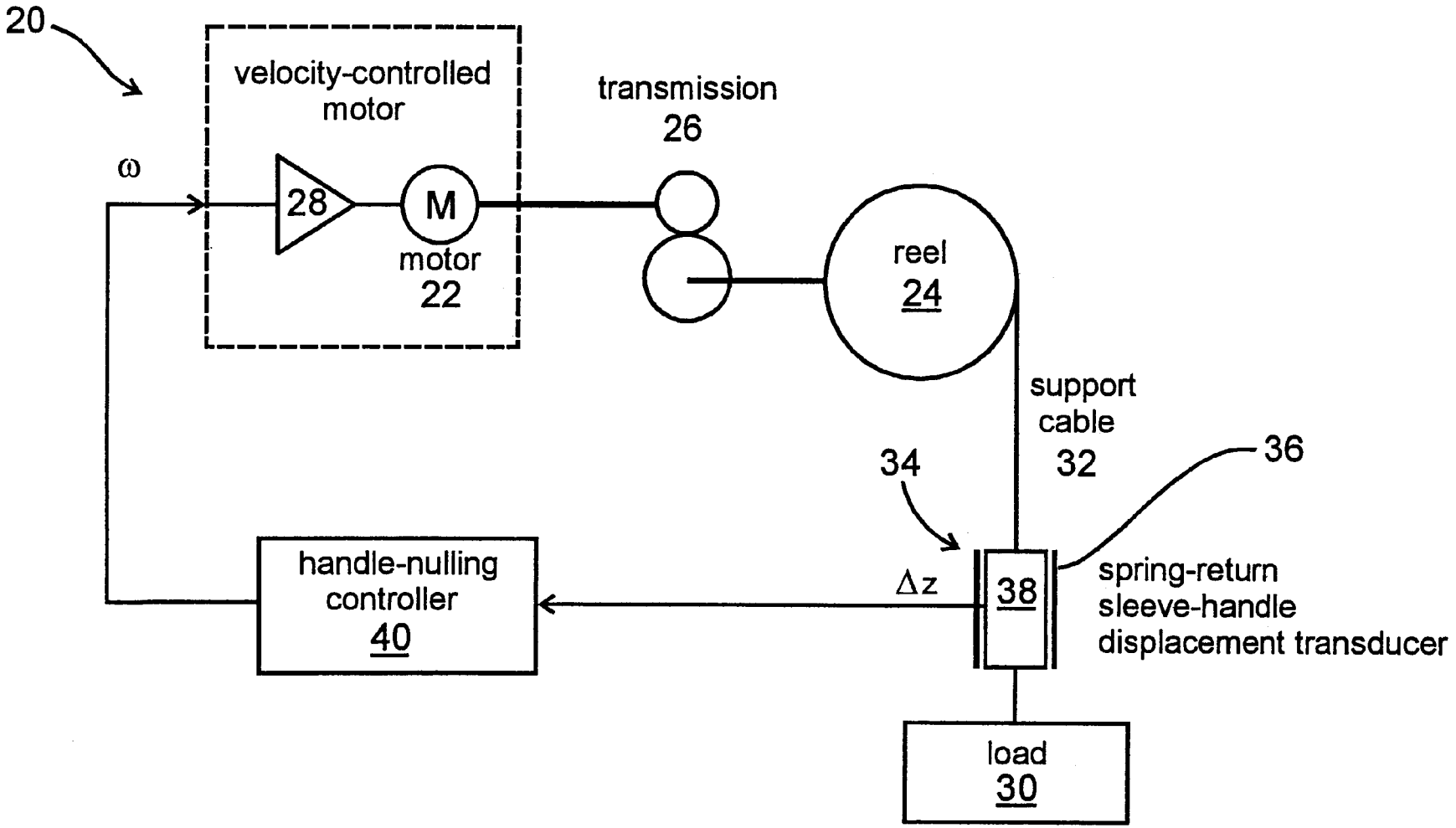
FIG. 1 shows a block diagram of an illustrative system employing a handle-nulling control operation mode applicable to the present embodiment.

Presented in FIG. 1 is a block diagram of a illustrative hoist or balancer that can be suspended from an overhead gantry rail system, jib crane or supported by any other type of supporting, frame structure, moving or fixed, to support a payload 30. The hoist preferably includes a motor 22 which can raise and lower the payload 30 attached to it by a support 32 such as a chain, cable, strut or some other kind of support means. The motor 22 may drive a gear to engage a chain that supports the payload 30, typically feeding the loose end of the chain back out the bottom of the unit. The hoist or balancer may also use a wire cable in place of a support chain, the motor 22 may drive a reel 24 which winds up the end of the support cable opposite the end attached to the payload 30. Preferably, the support 32 is a cable wrapped around a reel 24 or a chain engaged with a sprocket gear.

The motor 22 is preferably an electric motor but it could also be an appropriately controllable pneumatic or other type of device capable of providing a mechanical drive force. For example, an exemplary embodiment utilizes a Moog G413-625 brushless DC servo-motor 22 from Moog Inc. of East Aurora, N.Y. The motor 22 is preferably geared down via a transmission device 26, probably consisting of mechanical gears but may also be of any other type transmission coupling device, belts, chains, sprockets, viscous couplings, etc. An exemplary embodiment uses a 10:1 transmission ratio. The motor 22 could also drive the reel 24 directly without an intervening drive transmission device ("direct drive").

Typically, motors such as 22 are used together with a dedicated controller/amplifier 28 that provides low-level control of motor operations and they may sometimes even be physically combined as a single motor/amplifier unit 20.

The dedicated controller/amplifier 28 provides motor commutation, as well as low-level control functions such as closing a velocity-control loop around the motor 22 and amplifier driving the motor. Such dedicated controller 28 may be described as accepting as input a velocity signal to control the motor 22. In an exemplary embodiment a dedicated controller/amplifier is used, which is Moog model T200-410.

In the present embodiment, a number of advanced motor control functions and control modes are provided and described herein in additional to the basic dedicated controller/amplifier 28 motor functions. It should be understood that the advanced motor control functions and control modes may be implemented in a hoist controller (of which 40 is an example) separate from the conventional dedicated controller/amplifier 28, or the conventional controller/amplifier 28 functions can be incorporated into the hoist controller 40 providing the advanced motor functions. It should be understood that the trade-off between integrating low-level control functions together with the advanced control functions in controller 40 into a single controller, versus using a dedicated low-level controller 28 is largely a matter of design choice and may be implemented in either fashion by one skilled in the art. Similarly in other control modes subsequently described, the low level and advanced controller may be integrated or distinct.

The advanced controller 40 functions may be implemented in a variety of ways such as analog or digital electronics or as a digital computer with software or firmware programming the advanced functions, or as a combination of these devices. In an exemplary embodiment controller 40 is implemented as computer code running under the QNX real time operating system, on an Ampro LB3-P5E-Q-84 computer of the PC-104 form factor containing an Intel Pentium processor from Ampro Computers, Inc. of San Jose, Calif., a Diamond Systems MM-16 analog/digital board from Diamond Systems Corp. of Palo Alto, Calif., an Opal-MM digital I/O board, and a custom printed circuit board in PC-104 form factor for signal conditioning. The advanced controller 40 may also have communication, analog or digital, with other devices or networks, or with a programmer or technician, via another computer or via a keyboard, or via a network. In an exemplary embodiment the controller has ethernet and serial communications channels.

Sensor Devices

In the preferred embodiment, a number of sensor devices provide inputs to the hoist controller to enable the controller to move the hoist 20 appropriately according to the control mode, the operator input, the load and other parameters that define the particular hoist control situation. Many of the potential sensor inputs are listed below, but for many of the control modes to be described herein, not all of the sensors are needed and may be omitted. On the other hand, additional sensor devices may also be utilized as necessary to provide particular feedback information to the hoist controller 40 to implement advance control functions. It should be understood that these sensor signals are typically noisy and it is often beneficial to filter signals from the sensors, e.g. with a low-pass filter or other filter, prior to use of their values in a controller. Filtering techniques are well known to those skilled in the art and will not be described here. It should be assumed that where sensor signals are called for, these may be filtered signals. Furthermore, there are derived signals that may be obtained from sensors, such as acceleration or displacement by differentiation or integration of a velocity signal. Again, these techniques are well known and will not be described here.

A number of exemplary sensor devices and the parameters they monitor are described below:

Motor Characteristics—The motor 22 current, angular velocity, and angular displacement of the motor 22 may be monitored by several types of sensors well known to those skilled in the art. In an exemplary embodiment, these quantities are available as analog output signals from the Moog T200-410 dedicated controller.

Output Torque—The torque on the output (downstream) end of the transmission 26 driven by the motor 22 shaft may be monitored by a rotating torque sensor of many different types.

Payload Force—A load cell measuring the total downward force of the payload 30 (including any forces applied to the payload by the operator) can provide essentially the same information as obtained from the rotating torque sensor. In an exemplary embodiment the load cell is an Entran ELHS-T1E-1KL from Entran Devices, Inc. of Fairfield, N.J., and is used in preference to the torque sensor or motor current monitor described above.

Reel Position—Although the angular displacement of reel 24 is directly related to the motor 22 angular displacement, the reel angular displacement may be monitored by an absolute encoder. With an absolute encoder, the absolute angular displacement of the reel 22 (and therefore the absolute height of the payload) can be directly determined without complications caused by indexing an incremental encoder or multiple revolutions of the motor. Preferably, an absolute encoder is used to determine reel angular displacement. The encoder may be embodied in a number of ways such as a multi-turn potentiometer or any other type of encoder. In an exemplary embodiment the encoder is a 10 turn hybrid potentiometer 8143R from BI Technologies of Fullerton, Calif. It may also be embodied as an incremental encoder on the reel or on the motor, in combination with an indexing mechanism or with a rough absolute encoder for the reel's rotation.

Operator Interface—A sensor to measure the operator's intent to move the payload 30 in an up and down motion. In a preferred embodiment the interface may include a spring-return slide-handle with an encoder that measures displacement. The encoder may be one of any type measuring a displacement of the handle. Also, a preferred embodiment uses an inline slide-handle 34 positioned concentric with the cable 32 supporting the payload 30, and which reads displacement of the outer sleeve 36 of the handle 34 with respect to the handle core 38 to indicate the desired motion of the payload 30. However the operator interface may also be a force sensor, or a stiff enough displacement sensor that it approximates a true force sensor. In other embodiments, the interface may also be mounted in a fashion not concentric with the payload cable 32. It may also be a joystick, or part of a multi-axis force sensor. The operator interface need not be read with reference to payload motion and in other embodiments need not be mounted to the payload in any way. In still other embodiments, the operator interface may also include a plurality of such sensors mounted in various positions and whose signals are combined to provide a variety of locations at which an operator may place his hands on an intent sensor.

Operator Deadman—There may also be a grasp-switch to determine whether or not an operator is grasping the intent sensor. This may be implemented as a light-beam, or a pressure switch, or a lever to be displaced, or any other switch of known type that is triggered by the presence of the operator's grasp In an exemplary embodiment, a grasp switch is not used, but rather the motion of the operator interface handle beyond a preset small amount is used to indicate affirmative grasp.

Accelerometer—A measure of payload acceleration may be obtained from an angular accelerometer on the motor 22 or on the reel 24, or a linear accelerometer on the end effector, handle or payload. In an exemplary embodiment the motor acceleration is used in place of a measure of payload acceleration.

Limit and Detector Switches—A number of switches and potentiometers may also be provided as sensors to limit the up/down motion of the hoist. In an exemplary embodiment an electronic circuit uses a comparator and digital logic elements to detect motion of the reel and thus of the payload beyond preset locations, based on the signal from the reel absolute encoder potentiometer described above.

Handle Operation Mode

In an illustrative embodiment, a handle operation or handle-nulling mode is provided to enable an operator to direct and control the payload 30 as manually directed by the operator. In this mode, the operator manually directs a graspable slide-handle 34 as shown in FIG. 1. The slide-handle 34 of the illustrative embodiment includes a sleeve 36 and a core 38 referenced to the payload 30. The slide-handle 34 provides an output signal indicating Δz, which corresponds to the displacement of the sleeve 36 of the slide-handle with respect to its core 38 as the operator applies a force to the sleeve 36 to indicate the operator's intent in moving the payload 30. The output signal Δz can be input to the controller 40 of the hoist to indicate the operator's intent to move the payload.

The effect of the handle-nulling mode is to servo-control the hoist motor 20 appropriately to null the Δz signal produced by the operator through the handle 34. For example, if the operator applies an upward force to the slide-handle 34 and raises the sleeve 36 of the handle 1 cm with respect to the core 38, the hoist motor 20 is accordingly actuated to raise the payload 30 and thus the handle core 38 referenced to the payload by 1 cm, reducing the Δz signal to zero again. In this manner, the displacement of the sleeve 36 of the handle 34 is nulled by the raising of the payload 30 by the motor 20. Described most simply, the output of the controller 40 is an angular velocity signal ω sent to the motor 20. The angular velocity signal ω is derived from the measured handle-sleeve 34 displacement signal Δz indicating the operator's intent in raising or lowering the payload such that the motor can raise and lower the payload appropriately.

It should be noted that the basic objective of the controller 40 is to servo-control the motor 20 to raise the payload 30 to achieve Δz=0, that is, to keep the payload 30 at a constant vertical displacement with respect to the sleeve-handle 34 (and therefore, with respect to the operator's hand). In this manner, the payload 30 follows the operator's hand in raising and lowering the payload 30. In this embodiment, the controller 40 directs the hoist to move the payload to follow the position of the operator's hand through the handle 34.

This embodiment differs from systems that follow the force of the operator's hand applied to the handle. In this embodiment, force and position are not necessarily correlated. The relationship between applied force and hand position (Δz) may be quite variable, or even absent. The handle 34 of this embodiment, need not sense the manual force applied by the operator. For instance one possible embodiment of the sleeve-handle 34 measures and nulls Δz while having essentially zero hand-force, by measuring Δz of the sleeve optically. Another embodiment uses a return spring, but also uses a damper, so that again the operator's hand-force need not be directly related to its position Δz. In a preferred embodiment a damper is used in addition to a return spring.

It should also be noted that the motor 20 in this embodiment is also preferably operated in velocity-mode. As stated earlier, this low level control mode may be implemented by a dedicated controller 28 as shown in FIG. 1, or as part of the controller 40. The details of velocity-control need not be described as velocity-control of motors is generally well known in the field.

Figure 2:
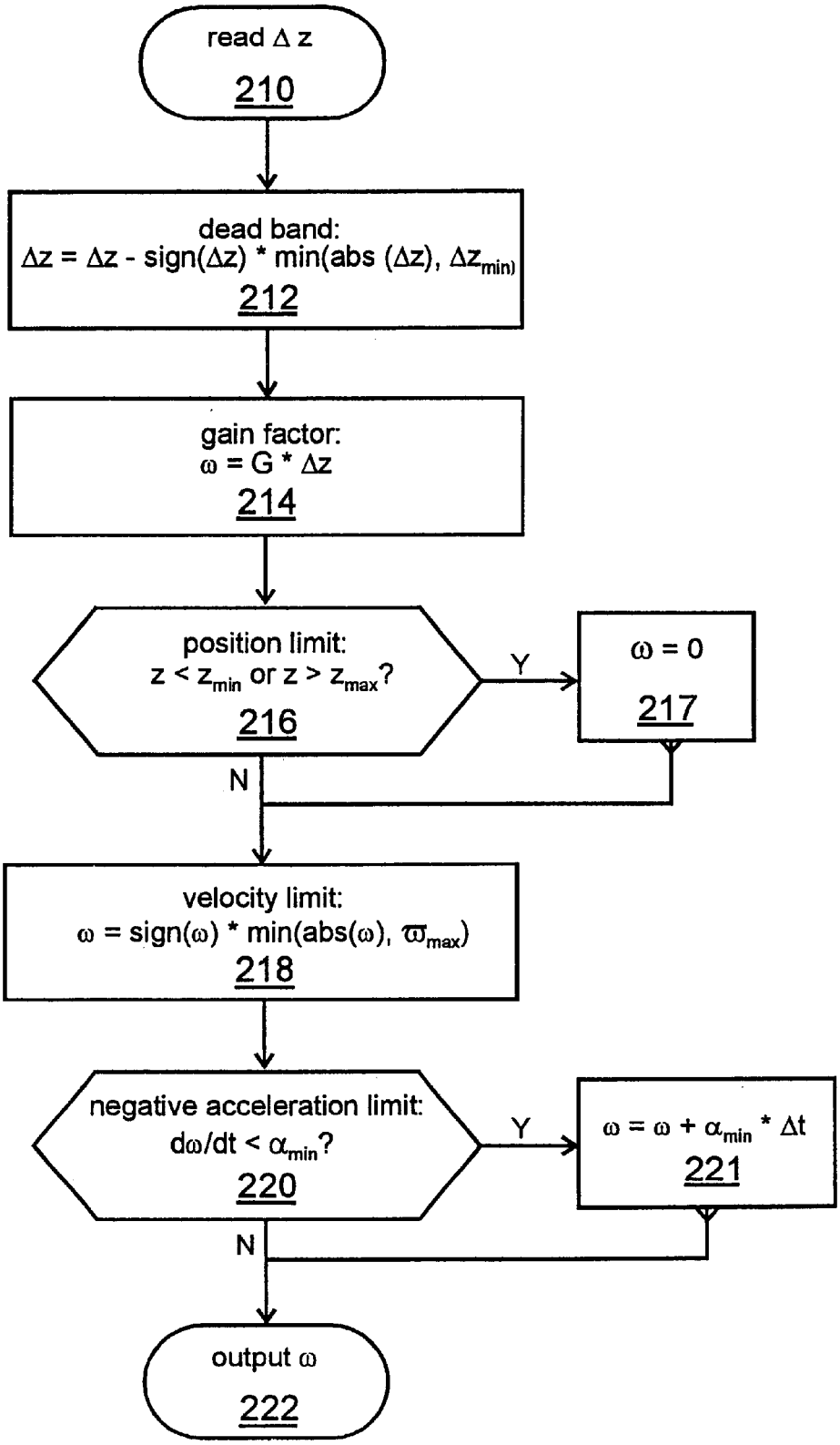
FIG. 2 shows a flow chart illustrating a preferred implementation of handle-nulling controller mode of the illustrative system of FIG. 1.

Referring now to FIG. 2, shown is the flowchart 200 illustrating the operation of the "handle-nulling controller" block 40 of FIG. 1 in more detail. In a preferred embodiment control block 40 is embodied as a software routine running at a cycle time of 500 Hz (Δt=0.002 seconds) under the QNX real time operating system. The flowchart of FIG. 2 describes a software implementation of the handle-nulling mode. The flowchart shows a software subroutine which is called a thread that is executed by a real-time operating system at programmed intervals, in this case every 2 milliseconds.

It should be understood that the description of FIG. 2 is simply one illustrative way of implementing the handle-nulling controller block 40. Scheduling threads under a real-time operating system (RTOS) is a particular embodiment that can be utilized by modern computer control systems, but the same algorithm could also execute periodically on a computer in many other software operating systems and environments. Indeed, the software could be executed on a microcontroller or microprocessor or DSP or implemented as an ASIC. Additionally, control block 40 may also be implemented as digital or analog electronics.

The operation of the thread of the exemplary embodiment of the handle-nulling mode of FIG. 2 is as follows. At step 210, the signal Δz is read in, representing the displacement of the sleeve 36 of the slide handle 34 with respect to its core 38 as previously described above. The handle 34 can be implemented in a variety of different embodiments as previously described. At step 212, the signal Δz is compared to stored quantity $\Delta z_{min}$ to determine if the operator's input to move the payload exceeds a desired threshold or "dead-band" of the system. If Δz is in magnitude less than a stored threshold quantity $\Delta z_{min}$, Δz is reduced to zero to implement a "dead-band" of handle-displacements within which no payload motion is initiated within the threshold. If Δz is in magnitude greater or equal to $\Delta z_{min}$, Δz is reduced in magnitude by an amount $\Delta z_{min}$, according to the equation shown.

Dead-band 212 could be eliminated if a grasp-sensor is used to enable motion, because if it is known that the operator is grasping the handle then it may be assumed that any signal Δz, no matter how small, is truly an operator request for motion.

At Step 214, Δz is scaled by a gain factor G, a stored quantity, which represents the closed loop gain. The gain factor G can be varied to change the responsiveness of the system. The product of G and Δz is ω, which is to become the output of the thread after further processing. In this embodiment, ω is to be the angular velocity command to the motor. As illustrated only a proportional term G is used, however optimization of performance can be done with additional terms as is known to those skilled in the art of automatic control.

At Step 216, the absolute position of the payload z, which is derived from the absolute angular reel displacement sensor described earlier or from another sensor which provides this information, is compared to upper and lower limits which are stored values $z_{min}$ and $z_{max}$. If the upper or lower position limits are exceeded, the reel angular velocity command ω is set to zero at step 217 to stop payload motion.

At Step 218, ω is compared in magnitude to a stored quantity $\omega_{max}$ representing a value limiting the speed of the motor, reel or payload. If $\omega_{max}$ is exceeded, ω is reduced in magnitude to the $\omega_{max}$ value to implement a governor or speed limit for the hoist and the payload.

At Step 220, the time rate of change of the velocity signal ω is found by comparing the newly computed ω to its previous value in the previous iteration of the thread and dividing by the time interval. If this time rate of change dω/dt is more negative in value than a stored negative value $\alpha_{min}$, ω is moderated according to the formula shown at step 221. The moderation of step 221 prevents downward acceleration of the payload of so great a magnitude that cable slack or other undesired effects may occur. A limit on positive acceleration could similarly be applied to prevent a sudden raising of the payload.

At Step 222, the computed value ω is returned by the thread to indicate the control operation of the motor, and the thread terminates.

In this manner, a highly responsive handle control or handle-nulling operation mode is provided.

Payload Mass Estimation

According to another embodiment, the system maintains a stored variable "m" representing the mass of the payload 30 (FIG. 1) and of any tooling or end-effector, but excluding any apparent mass due to acceleration of the payload. The mass m of the payload 30 may change suddenly when a payload 30 is picked up or offloaded, or slowly if a substance is added to or poured from the payload. The system mass quantity m, however, accurately maintains the varying mass of the payload.

In this embodiment, mass m of the payload 30 can be determined when the hoist 20 is operating in handle-nulling mode and the payload is moving. At such times it may be safely assumed the operator is not applying significant forces directly to the payload 30, because the operator has chosen to grasp handle 34 to direct the movement of the payload 30. Further, the apparent mass due to inertial forces arising from the acceleration of the payload 30 can be corrected for as well to accurately estimate the mass of the payload 30. The estimate of the payload 30 mass m will be utilized in the hoist float-mode, which will be described subsequently herein. This embodiment differs from prior art devices in which payload mass is estimated upon pickup, and in which no acceleration of the payload is allowed during its measurement. Further, an up-to-date estimate of payload mass is maintained, enabling the float control mode to work responsively in more diverse situations.

A thread for estimating payload mass m is executed frequently, e.g. at 100 Hz, 200 Hz, 500 Hz, etc. Depending on the hardware, it takes as input the sensor readings for reel torque, or payload load cell force, or motor current. It can be assumed that any one of these sensor measurements has been converted in units into an effective apparent payload weight which will be designated w. It also takes as input reel angular acceleration or motor angular acceleration or payload linear vertical acceleration. We will assume that any one of these measurements has been converted in units into an effective payload vertical acceleration which will be designated (a). Of course, all of these sensor inputs may be filtered, and the output m is preferably filtered as well. In an exemplary embodiment, payload apparent weight as measured by a load cell force and angular acceleration of the motor as reported by the dedicated motor controller/amplifier may be used.

Figure 3:
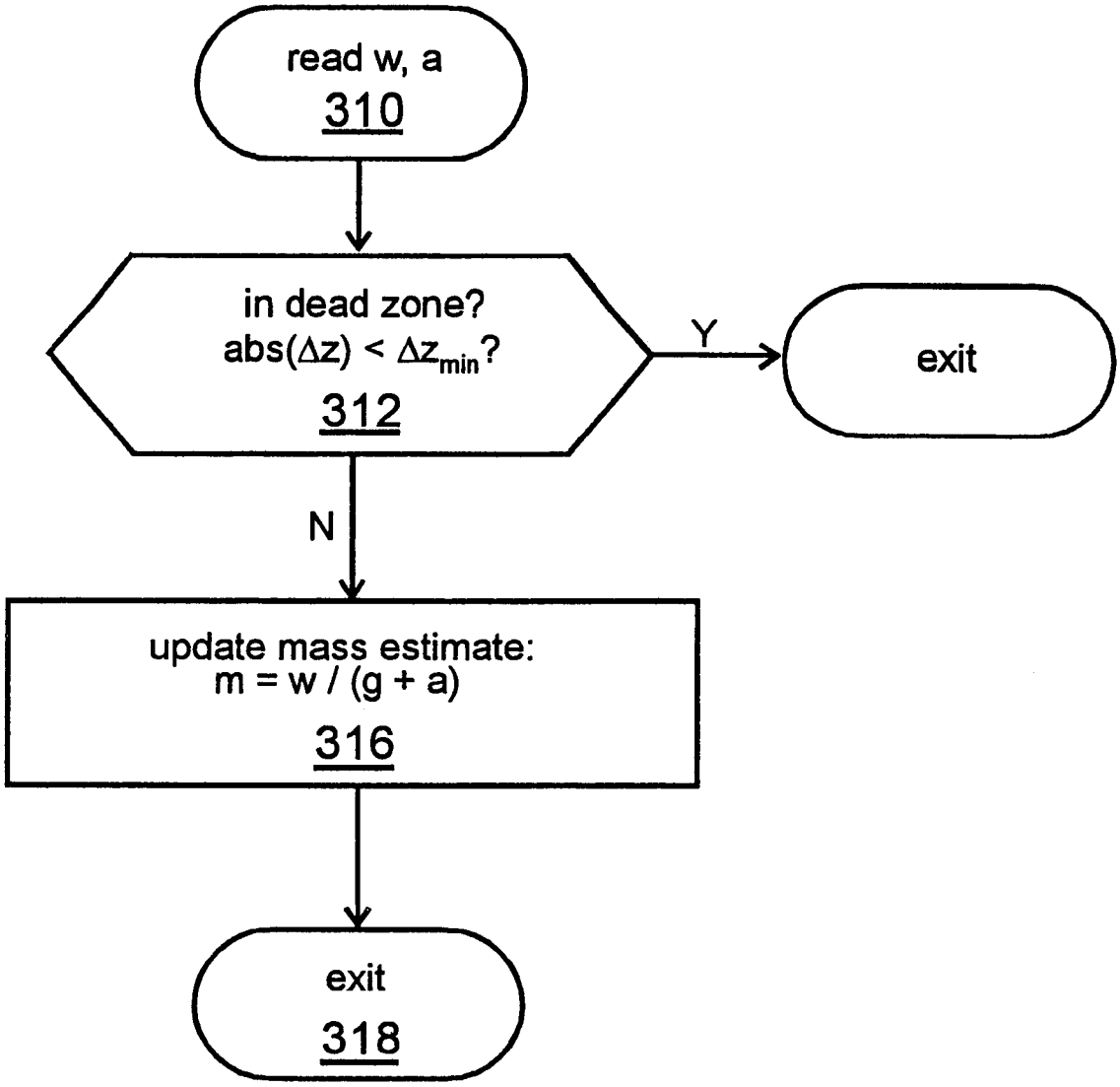
FIG. 3 shows a flow chart of an exemplary embodiment of a payload mass estimation technique.

Referring now to FIG. 3, shown is a flow chart illustrating a thread of the present embodiment of a method for estimating the payload mass. At Step 310, the values (possibly filtered) for payload weight (w) and acceleration (a) are read in. These values can be obtained, for example, from the sensor measurement devices described above. At Step 312, the operator's displacement of the handle Δz is compared to the stored $\Delta z_{min}$ value representing the dead-band threshold of the hoist system. If the operator handle is displaced from its null position less than the dead-band of the system $\Delta z_{min}$, an updated measurement of the estimated mass (m) is not obtained and the thread can terminate at Step 314 to be executed at the next cycle time. If the operator handle is displaced from its null position greater than or beyond the dead-band of the system, the mass estimate m is updated at Step 316.

At step 316, the estimated mass is updated according to the formula m=w/(g+a), which accounts for apparent weight due to gravity "g" as well as any force due to acceleration "a" of the payload 30. In addition, the output mass estimate m may also be filtered both for random noise and spurious large impulses due to collisions, etc., before being output and exiting at Step 318.

It should be noted that the payload mass estimate m is not only useful for implementing float mode as described below herein, but also provides a fast and continuous estimate of the payload mass, which may be supplied to the operator through a display, or to a computer system, as if the payload mass were being weighed by a scale. The payload mass estimate of the present embodiment, however, provides a virtual scale that does not need time to settle and is not affected by acceleration of the payload, because the estimated mass m corrects for any acceleration.

Float Mode Operation

According to another embodiment, the hoist system is provided a float control operation mode to allow an operator to move the payload by applying force directly to the payload. In float mode, the operator's force is applied directly to the payload to move the payload in the desired manner, as opposed to an operator actuated a slide-handle or other type of intent sensor. A number of key properties that can be implemented by the float mode include:

Gravitational Counterbalance—the float-mode controller should generate a nominal upward force sufficient to counteract the downward pull of gravity on the payload allowing the payload to be suspended in place in the absence of any applied operator forces.

Absence of Drift—when not in use by the operator, i.e., when no forces are applied by the operator to the payload, the float mode controller should hold the payload in place and not cause the load to drift either up or down.

Compliance—the float mode controller should be somewhat compliant so as to allow smooth and natural control of fine up/down motions. The magnitude of this compliance should be adjustable.

Absence of Oscillations—the need for compliance notwithstanding, the float mode controller should also not feel unduly "springy", nor should it allow noticeable oscillations of the payload to persist after the completion of a movement.

Velocity Limit—the float mode controller should not allow the operator to move the load above a maximum safe up/down speed.

An example of one physical suspension having the desired characteristics of the ideal preferred float mode controller is described with reference to FIG. 4. Ideally, the hoist float mode controller 42 of FIG. 6 drives the hoist motor 22 such that the motion of the payload 30 in response to the operator's forces is indistinguishable from the motion the payload 30 would experience if it were suspended by the physical implementation of the mechanical suspension system of FIG. 4. However the components of the mechanical suspension system need have no physical embodiment; as such is it is a virtual suspension implemented by the float-mode controller. The float-mode is designed to have the qualities above, and in general to produce a pleasing and highly-responsive float-mode from the point of view of the hoist operator.

Figure 4:
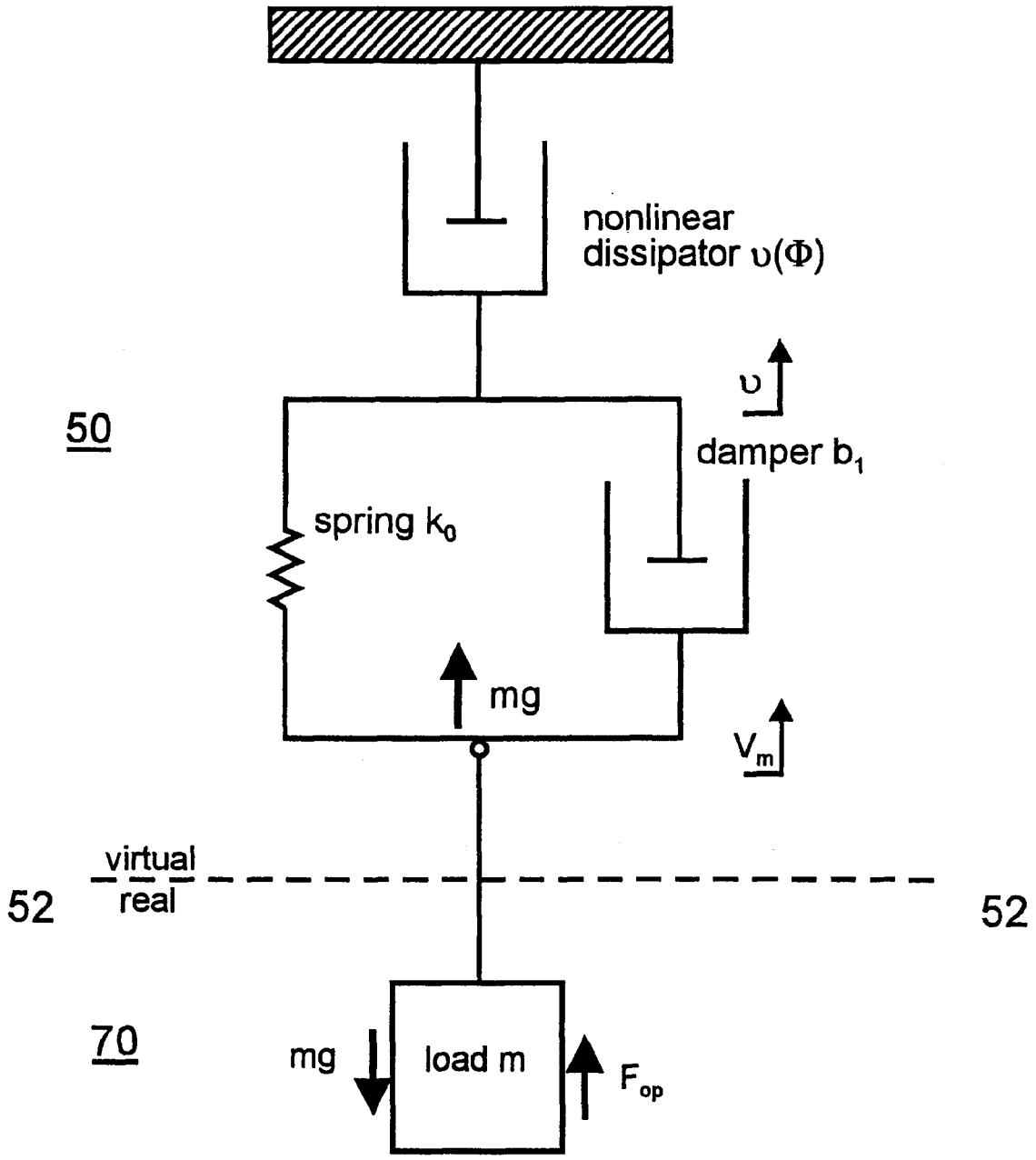
FIG. 4 shows a virtual mechanical suspension which is simulated by the controller as an implementation of a float control mode.

FIG. 4 shows a mechanical representation of a physical embodiment of the virtual suspension 50 above the dotted line 52, and some of the real components of the hoist 70 shown below the dotted line 52. The real payload m experiences a real force mg due to gravity and it experiences the operator's real applied force $F_{op}$. The virtual suspension 50 consists of an upward force mg which is intended to counterbalance gravity, a linear damper $b_1$ with damping constant $b_1$, a linear spring $k_o$ with spring constant $k_0$, and a non-linear dissipator $\nu(\Phi)$ which relates its velocity $\nu$ to the force it experiences $\Phi$ according to a schedule shown in FIG. 5. It should be understood that the many variations or embellishments can be made to the system of FIG. 4 within the intent of the present embodiment; for instance, either the damper $b_1$ or the spring $k_0$, or both, may be eliminated; also, the shape of the schedule in FIG. 5 may be altered.

While the linear damper $b_1$ has a linear force-velocity curve with a slope $1/b_1$, the non-linear damper $\nu(\Phi)$ has a non-linear curve as shown in the schedule response curve of FIG. 5 and described below. The desired schedule response curve includes several different regions 1, 2, 3 with breakpoints $\Phi_2$ and $\Phi_3$ between them on the force axis, and regions 1, 2, 3 with slopes 0, $1/\beta_2$, and $1/\beta_3$ respectively. The same schedule is repeated symmetrically for negative forces.

Figure 5:
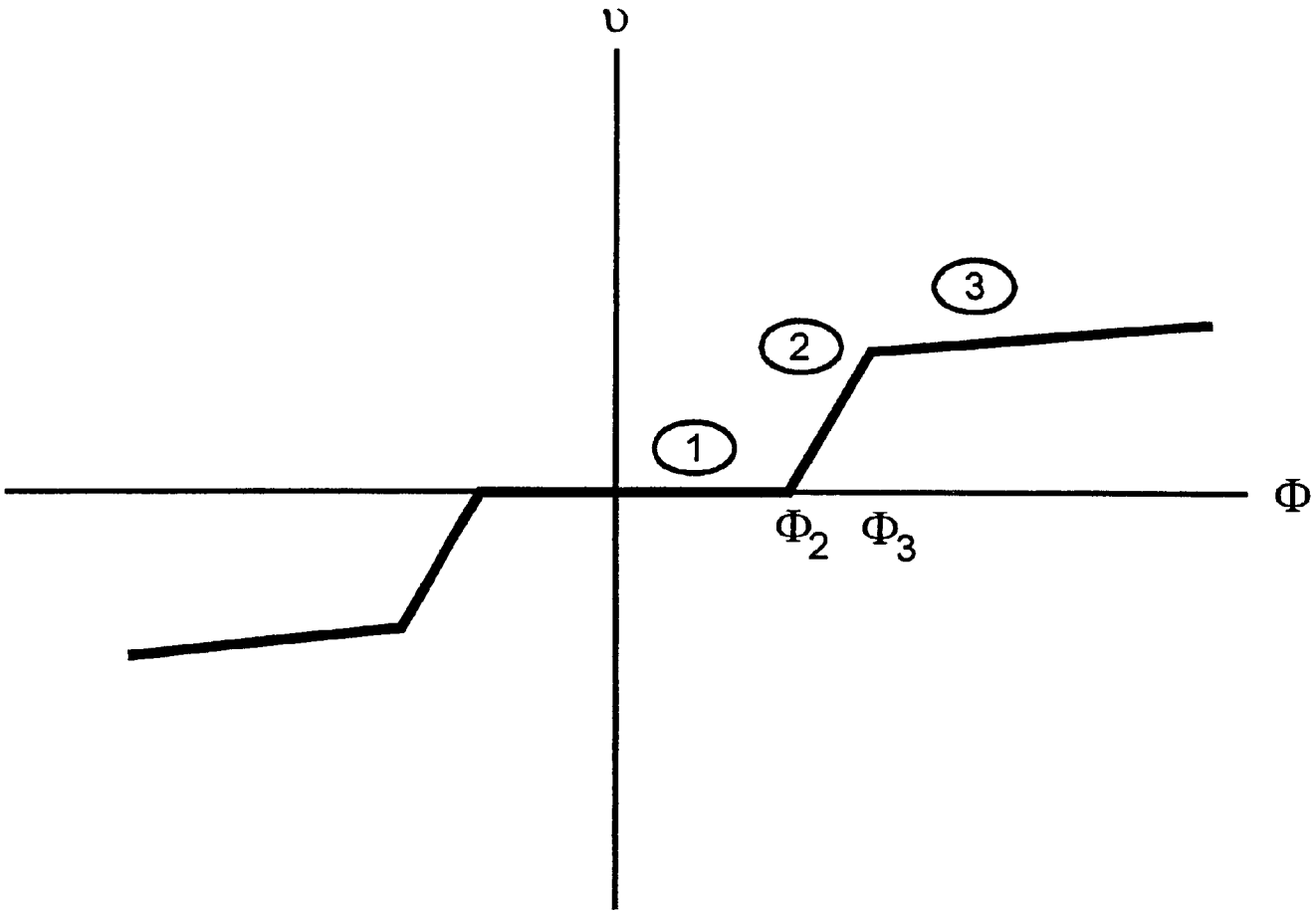
FIG. 5 shows a gain schedule for the nonlinear dissipator used in the simulated mechanical suspension used in float control mode.

The schedule of FIG. 5 influences how the system 50 responds to the applied forces. In region 1, the operator applied forces are not of a magnitude sufficient to cause motion of the nonlinear dissipator $\nu(\Phi)$. Thus, no motion or only small amounts of motion are allowed by the spring $k_o$. Region 1 implements the following features:

Perfect Counterbalance: if the load mass estimate m is somewhat in error, and the magnitude of the error $\delta m$ is such that $-\Phi_2<\delta mg<\Phi_2$, the spring $k_o$ simply extends or compresses until the force in the spring, plus the estimated counterbalance force, perfectly counteract the true gravitational load.

No Drift: if the magnitude of the mass estimate error is within the limits above, the load will not drift either up or down.

No Oscillations: the damper $b_1$ is sized to damp out oscillations.

Compliance: the spring $k_o$ ensures that the suspension responds to even very small operator forces with small up/down motions.

In region 2, the dead-band threshold $\Phi_2$ is exceeded, and the nonlinear damper $\nu(\Phi)$ allows the payload significant velocity proportional to the operator's applied force, according to the slope $1/\beta_2$ (the payload velocity is actually proportional to $1/\beta_2+1/b_1$; however, the term $1/\beta_2$ should be much larger than $1/b_1$). In region 2, the operator will normally make gross up and down motions to move the payload in the desired direction.

However, excessive velocity in float-mode should be avoided, so above a certain point $\Phi_3$ region 3 is entered in which only a small increment of velocity, proportional to $1/\beta_3+1/b_1$ is allowed for any further increases in applied operator force. The slope $1/\beta_3$ of region 3 is preferably less than that of slope $1/\beta_2$ of region 2 to enable a reduction of velocity of the payload. It should be understood that many variations could be made on the schedule within the intent of the present embodiment.

Described below are two embodiments of an advanced hoist controller 42 suitable for implementing the virtual suspension represented in FIG. 4. The first embodiment of FIG. 6 allows the hoist motor 22 to be operated in a torque operation mode, and does not require any measure or estimate of the operator's real applied force $F_{op}$. In this mode, only measures of the load position (z) and velocity ($\nu$) are required and these values can typically be obtained with high fidelity using appropriate sensor measurement devices. The alternate embodiment of FIG. 8, allows that the hoist motor 22 to be operated in velocity mode and requires that an estimate of the operator's real applied force $F_{op}$ be available.

Figure 6:
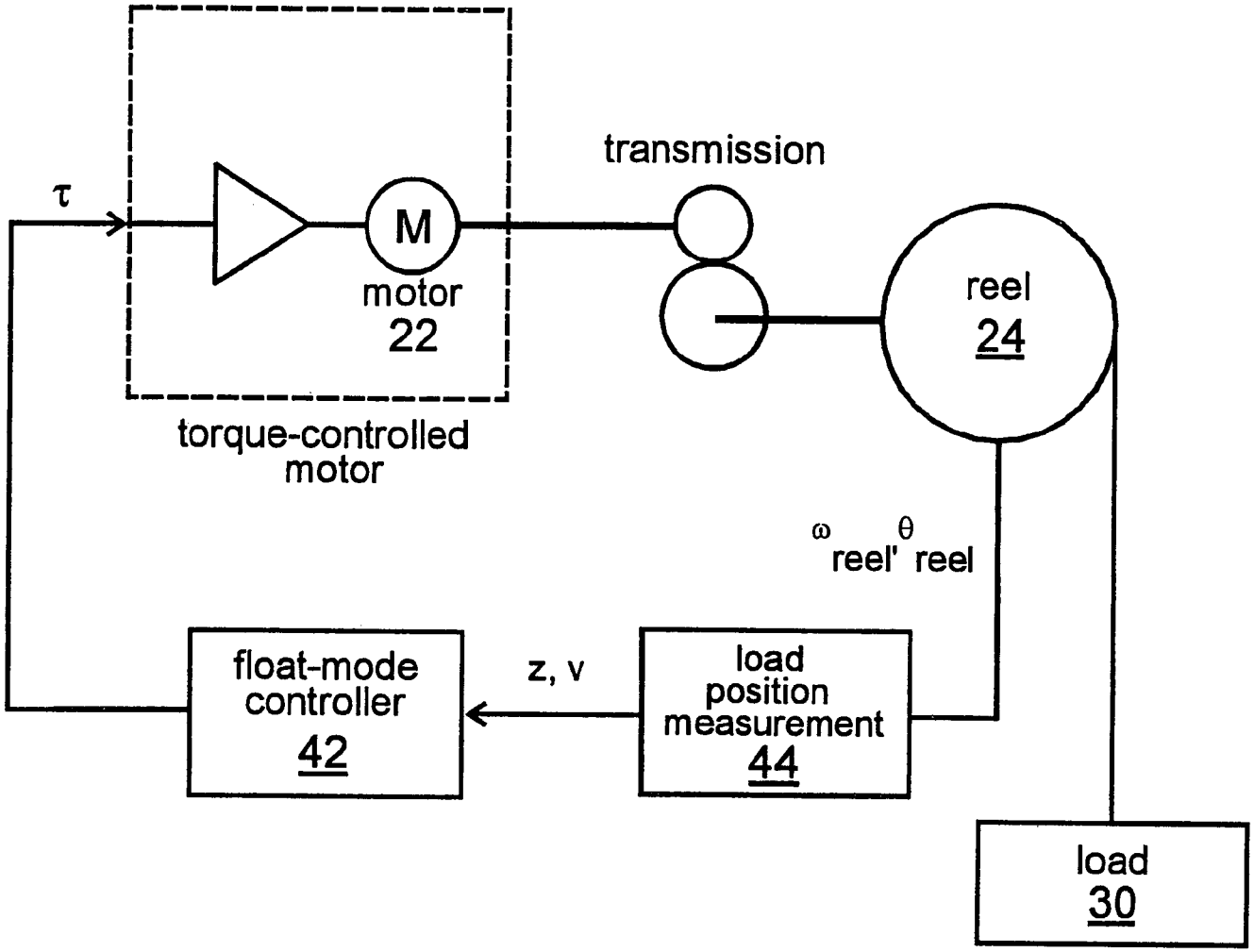
FIG. 6 shows a high-level diagram of an exemplary system providing a float-mode control according to a preferred embodiment.

FIG. 6 shows a high-level diagram of an exemplary system 100 providing a float-mode according to an illustrative embodiment. In this embodiment, the float-mode controller 42 operates the motor 22 in torque mode, and the feedback sensor signals to the controller 42 are the reel angle $\theta_{reel}$ and reel angular velocity $\omega_{reel}$. Load Position Measurement block 44 measures the load position (z) and velocity ($\nu$) determined from the reel angle $\theta_{reel}$ and angular velocity $\omega_{reel}$ using the various feedback sensor devices that have been previously described herein. This embodiment of the float control mode also uses a payload mass estimate which may, for example, be determined in handle-nulling mode according to the payload mass estimate method previously discussed with regard to FIG. 3.

The transmission 26 provides a ratio factor T between the revolutions of the motor 22 and the reel 24 winding the cable 32 supporting the payload 30.

Figure 7:
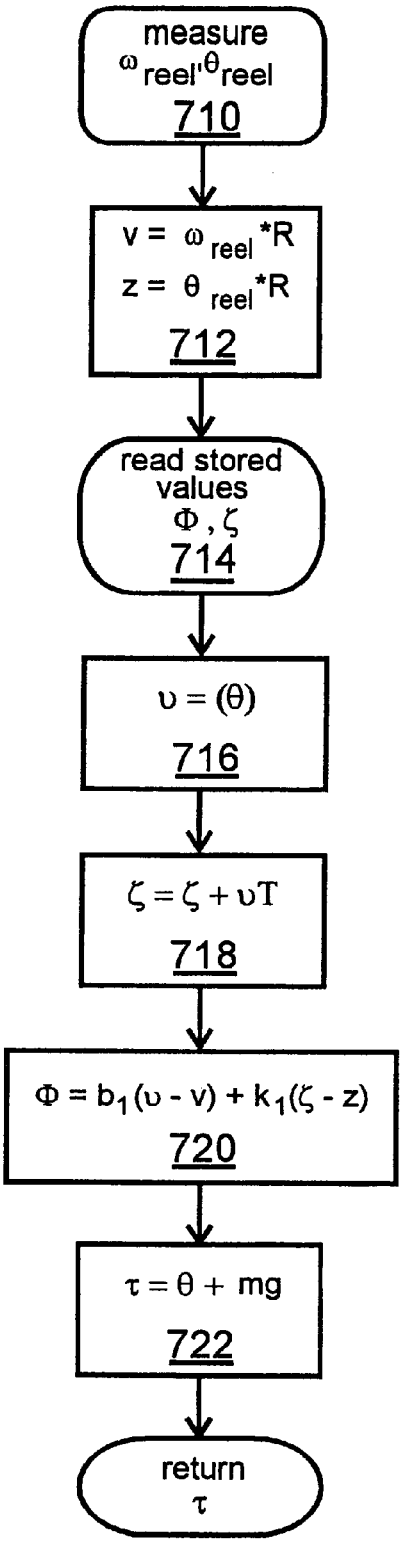
FIG. 7 shows a flow diagram of a method for implementing a system providing the response of the virtual suspension.

Referring now to FIG. 7, an embodiment of a method for implementing a hoist providing the response characteristics of the prototype virtual suspension of FIGS. 4 and 5 are described. In this method, $\zeta$ is an internal variable representing the position of the non-linear damper $\nu(\Phi)$, and T is the update rate. For computational simplicity, this method computes $\nu$ on the basis of the stored value of $\Phi$ (a value which is one time step old), and then goes on to compute the next value of $\Phi$. Standard implicit equation solvers can instead be used to compute $\nu$ and $\Phi$ simultaneously, so that $\nu$ is not based on an old value of $\Phi$. In the case of the piecewise linear schedule shown in FIG. 5, the implicit equations may be solved analytically.

At step 710, a measurement of reel angular velocity $\omega_{reel}$ and reel angle $\theta_{reel}$ are obtained from sensors described above herein. At step 712, the linear velocity and linear position of the payload are computed from the above measured variables by multiplying by the reel radius R. At Step 714, the stored values of force $\Phi$ and nonlinear dissipator displacement $\zeta$ are recalled. At Step 716, the simulated nonlinear dissipator velocity $\nu$ is computed from $\Phi$ according to the schedule of FIG. 5 or a variation on it. At Step 718, the stored value of nonlinear dissipator displacement $\zeta$ is updated. At step 720, the dynamic equation shown is used to compute the total simulated force $\Phi$, which is added to the counterbalancing force in mg in Step 722. The output of this thread is the returned value of motor torque $\tau$, which of course will be appropriately scaled for reel radius and transmission ratio of the particular hoist.

Figure 8:
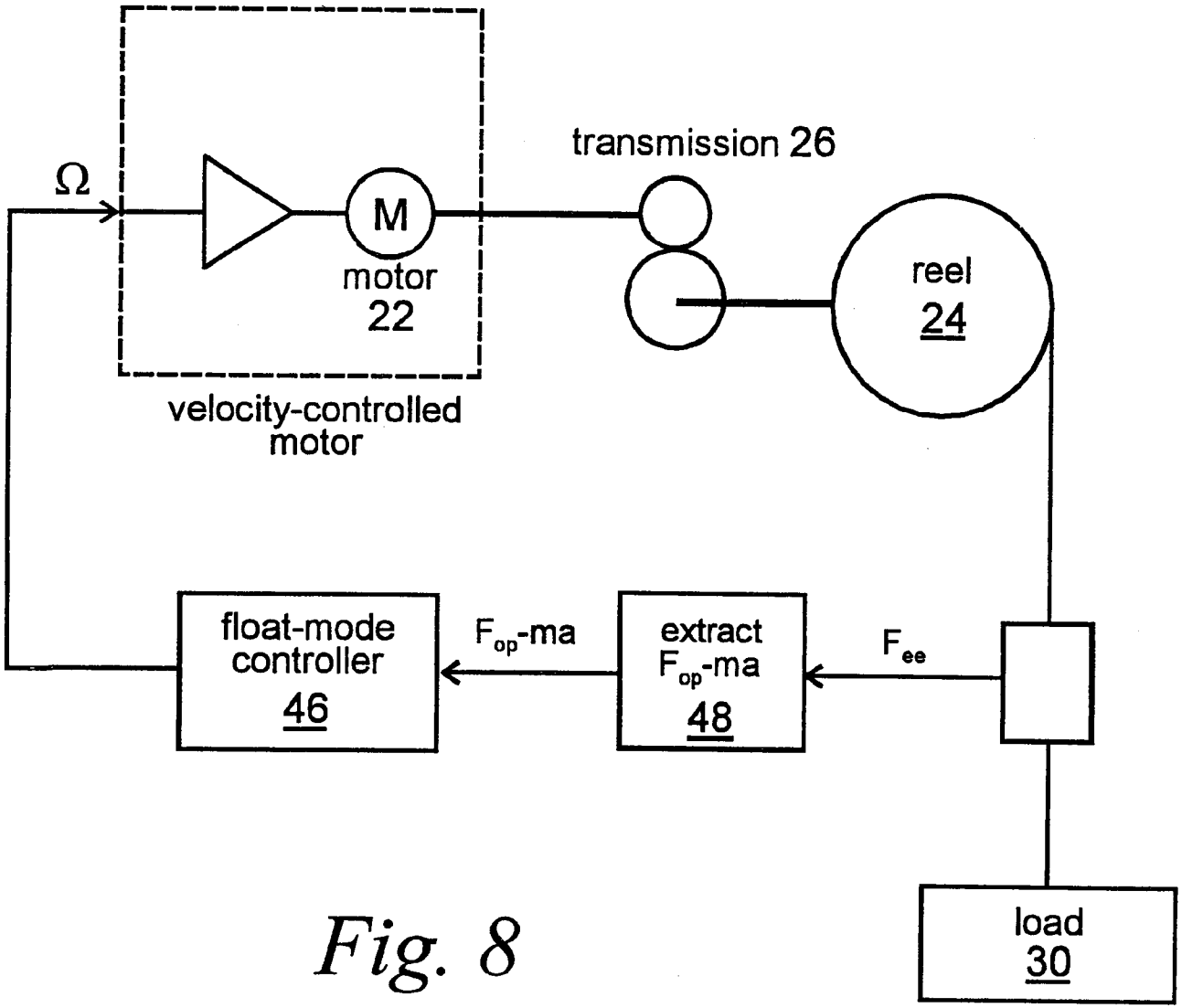
FIG. 8 shows a high-level diagram of an exemplary system providing a float-mode control according to an alternate embodiment.

Referring now to FIG. 8, shown is an alternate embodiment using the motor 22 in velocity-controlled mode. This embodiment is similar to that of FIGS. 1 and 6 including float-mode controller 46, a velocity-controlled motor 22, transmission 26 driving reel 24 winding the support cable 32 raising and lowering the payload 30. In this embodiment, the only feedback signal is the total end-effector force, $F_{ee}$, and the control command is the motor velocity, Ω, which is proportional to commanding the payload velocity v through the transmission 26, reel 24 and suspending cable 32. $F_{ee}$ may be determined in any of the ways described above herein under sensors: by a load cell, or by a torque sensor, or by motor current if the transmission is sufficiently back-drivable. An advantage of this embodiment is that a feedback loop is closed around the transmission by using the measured load cell or reel torque, thus the friction of the transmission does not degrade the float-mode performance by broadening the dead-band.

Figure 9:
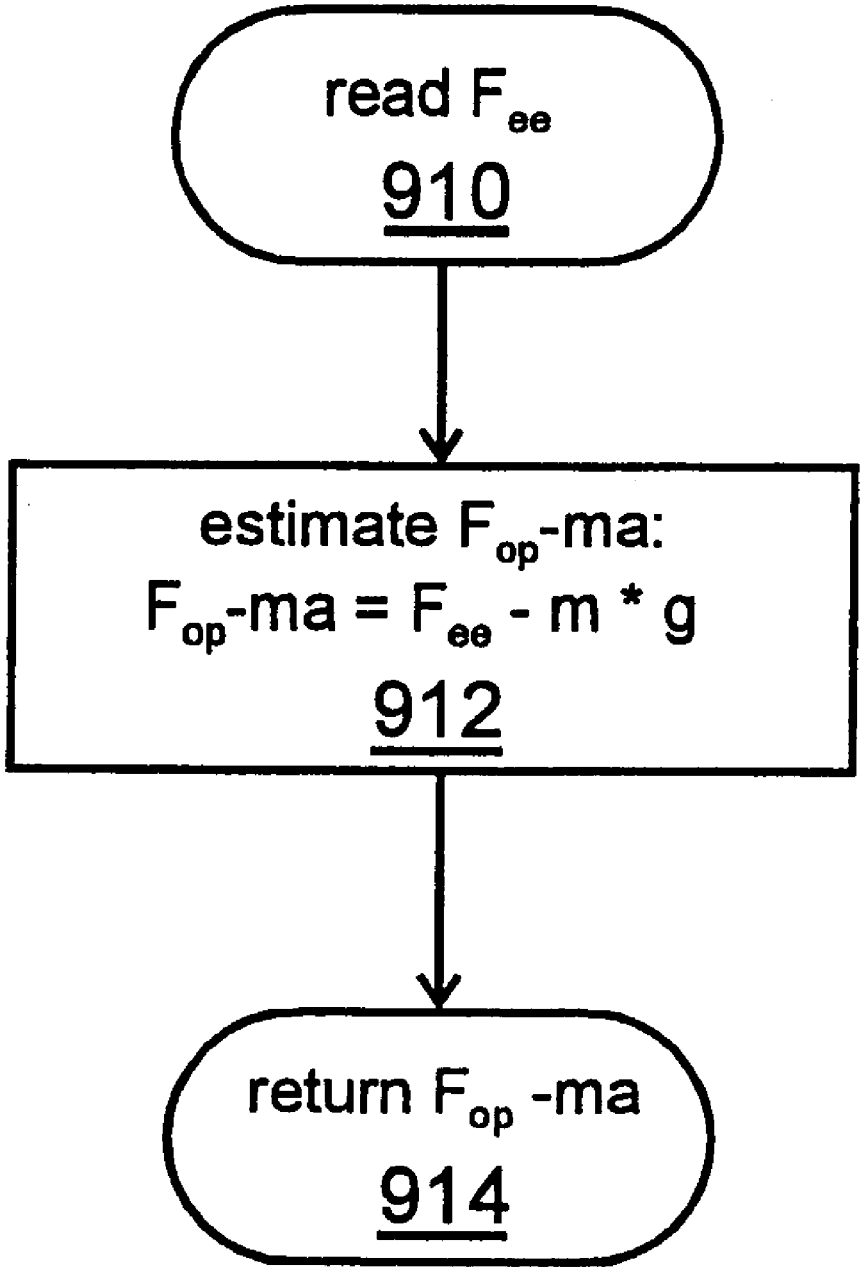
FIG. 9 shows a flow diagram of a method of extracting the operator force applied to a payload.

The total load on the suspending cable 32 includes several force components such as the operator's force, inertial forces due to acceleration of the load, and the weight of the load. To implement the behavior of the prototype suspension 50 described in FIGS. 4 and 5, we must subtract the gravitational force exerted on the payload 30. Another way of describing this is that only the operator's applied force to the payload and the inertial force are extracted. An alternative which, while it is not strictly faithful to the prototype suspension illustrated in FIG. 4, can nonetheless produce pleasing response, is to extract only the operator's applied force to the payload. The extraction of the operator's applied force to the payload and the inertial force can be accomplished as shown in the flowchart of FIG. 9. At step 910, the total load $F_{ee}$ on the suspended cable 32 is read in from a load sensor device. The total load $F_{ee}$ may be measured in a variety of ways, such as using a load cell, reel torque sensor, or by measuring the motor current. Which of these load sensor devices is used depends on the particular hardware implementation and may be left to those skilled in the art. We will assume that any one of these measures for the total load on the suspending cable 32 has been converted into units appropriate for an effective total end-effector force which will be designated $F_{ee}$. At step 912, an estimate of $F_{op}$−ma is made using $F_{ee}$−m*g. A stored value for the estimated mass m is used. As described previously, the output may be filtered for noise and spurious events.

Figure 10:
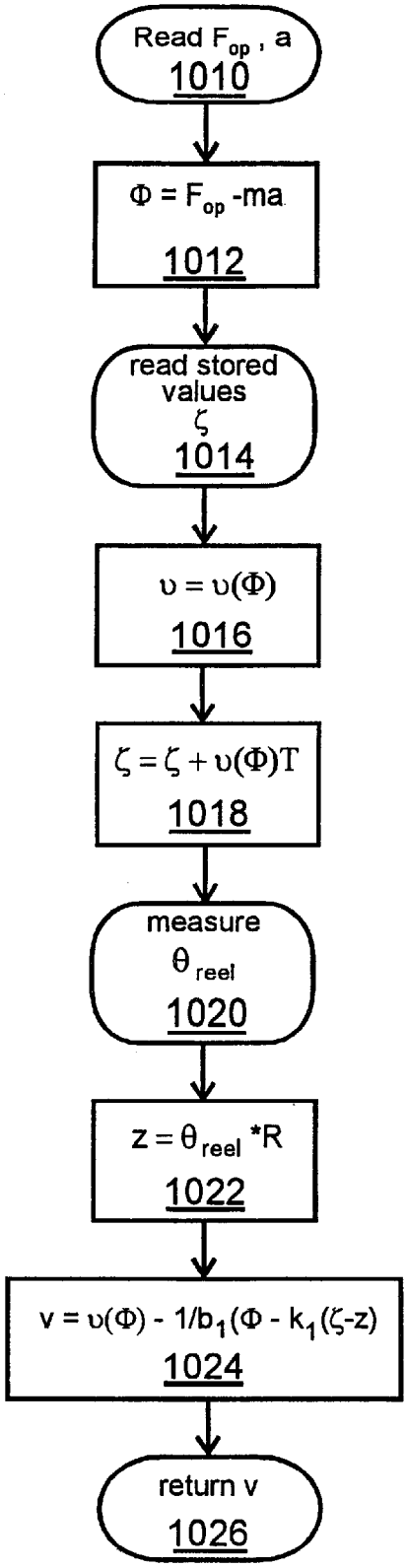
FIG. 10 shows a flow diagram of the overall control method for a preferred implementation of float control mode.

FIG. 10 shows a flowchart of the overall control method for the float mode embodiment of FIG. 8. The terminology used is the same as that for FIG. 7. At Step 1010, an estimate of $F_{op}$−ma is obtained from step 914. At Step 1012, this estimate is assigned to Φ, the force acting on the nonlinear dissipator v(Φ). AT Step 1014, the stored value of the nonlinear dissipator displacement ζ is recalled. At Step 1016, the simulated nonlinear dissipator velocity v is computed from Φ according to the schedule of FIG. 5 or a variation on it. At Step 1018, the stored value of the nonlinear dissipator displacement ζ is updated. At Step 1020, the reel angle $\theta_{reel}$ is obtained from sensors described above herein. At Step 1022, the linear position of the payload is computed from the above measured value by multiplying by the reel radius R. At Step 1024, the dynamic equation shown is used to compute the payload linear velocity v. The output of this thread is the velocity v, which of course will be appropriately scaled for reel radius and transmission ratio of the particular hoist before serving as a command to the motor's velocity controller In the float control mode embodiment of FIG. 6, the inner loop of control is torque-control. In the float control mode of FIG. 8, the inner loop of control is velocity-control. In handle-nulling mode embodiment as described above, the inner loop of control is velocity-control. In another embodiment, there is also a third mode, called hold-mode, in which the motor is operated under position-control. Position-control modes are well known in the art and will not be described here in detail.

The controller of the preferred embodiment, however, is also designed to switch among the three modes (float, handle-nulling, and hold) or any plurality of different modes and features. Described herein are methods for implementing the switching between the various operational modes of the controller. The mode switching algorithm can be expanded to incorporate many different software features in addition to the features disclosed and discussed herein.

The mode switching algorithm of the present embodiment utilizes the thread that estimates payload mass of FIG. 3 described above, running at the appropriate frequency. The thread that estimates operator force $F_{op}$, described above, continues to run. In this embodiment, the mode-switching algorithm essentially monitors both the slide-handle displacement Δz and the operator force estimate $F_{op}$. Using the method described in a flowchart below, the advanced function motor controller places the hoist into one of the three operational modes. The advanced function motor controller is placed into one of the three modes by scheduling the corresponding thread to run iteratively, and disabling the other threads. Simultaneously, the motor controller is placed into the corresponding low-level control mode: motor torque-controlled to accommodate hoist float-mode, motor velocity-controlled to accommodate hoist handle-nulling mode, and motor position-controlled to accommodate hoist hold-mode. If the second of the illustrative embodiments of float-mode is used, then the motor would be placed into the velocity-controlled low level mode for that too.

Of course, the low-level motor controller may also be integrated into our controller, rather than running as a separate dedicated controller. Also there are many other ways of switching between modes, both for thread-based computing platforms such as our preferred embodiment that runs under a real-time operating system, and for other computing environments.

Figure 11:
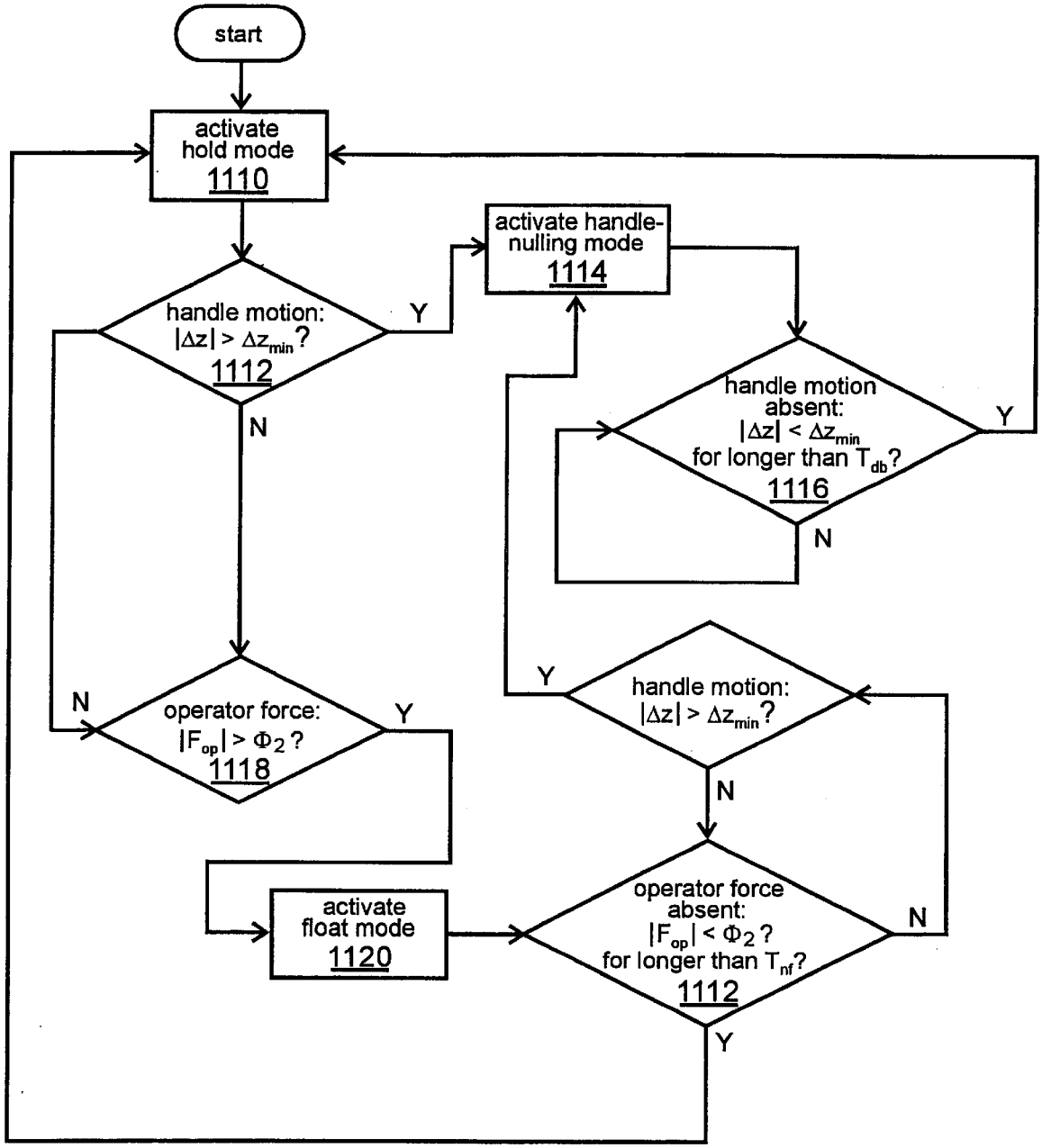
FIG. 11 shows a flow diagram of a preferred method for switching between various modes of controlling the hoist.

The logic of the mode switching thread is shown in FIG. 11. At Step 1110, the hoist is initially in hold mode which is position controlled to constant height as discussed above. At Step 1112, if the handle displacement Δz is above threshold value $\Delta z_{min}$, the hoist switches to handle-nulling mode at Step 1114. At Step 1116, if the handle displacement remains less than $\Delta z_{min}$ for a time period in excess of $T_{db}$ the hoist reverts to hold mode at Step 1110. When in hold mode, and in the absence of significant handle displacement, operator force is evaluated and compared to value $\Phi_2$ at Step 1118. If operator applied force in excess of $\Phi_2$ is detected, the hoist enters float mode at Step 1120. The hoist remains in float mode until significant operator force is found to be absent for a period of $T_{nf}$ at Step 1122, at which point the hoist gain reverts to hold mode 1110.

These exemplary embodiments shows how the various hoist control operation modes and features can be integrated to allow an operator ease in using the hoist to intuitively move payloads as desired. It should be understood, however, that many other embodiments are possible as well. For example, in this embodiment the hold mode is utilized as the default operation mode, although in other embodiments other modes such as the float-mode control may be used as the default mode.

Alternate Hoist Hardware Embodiments

Figure 12:
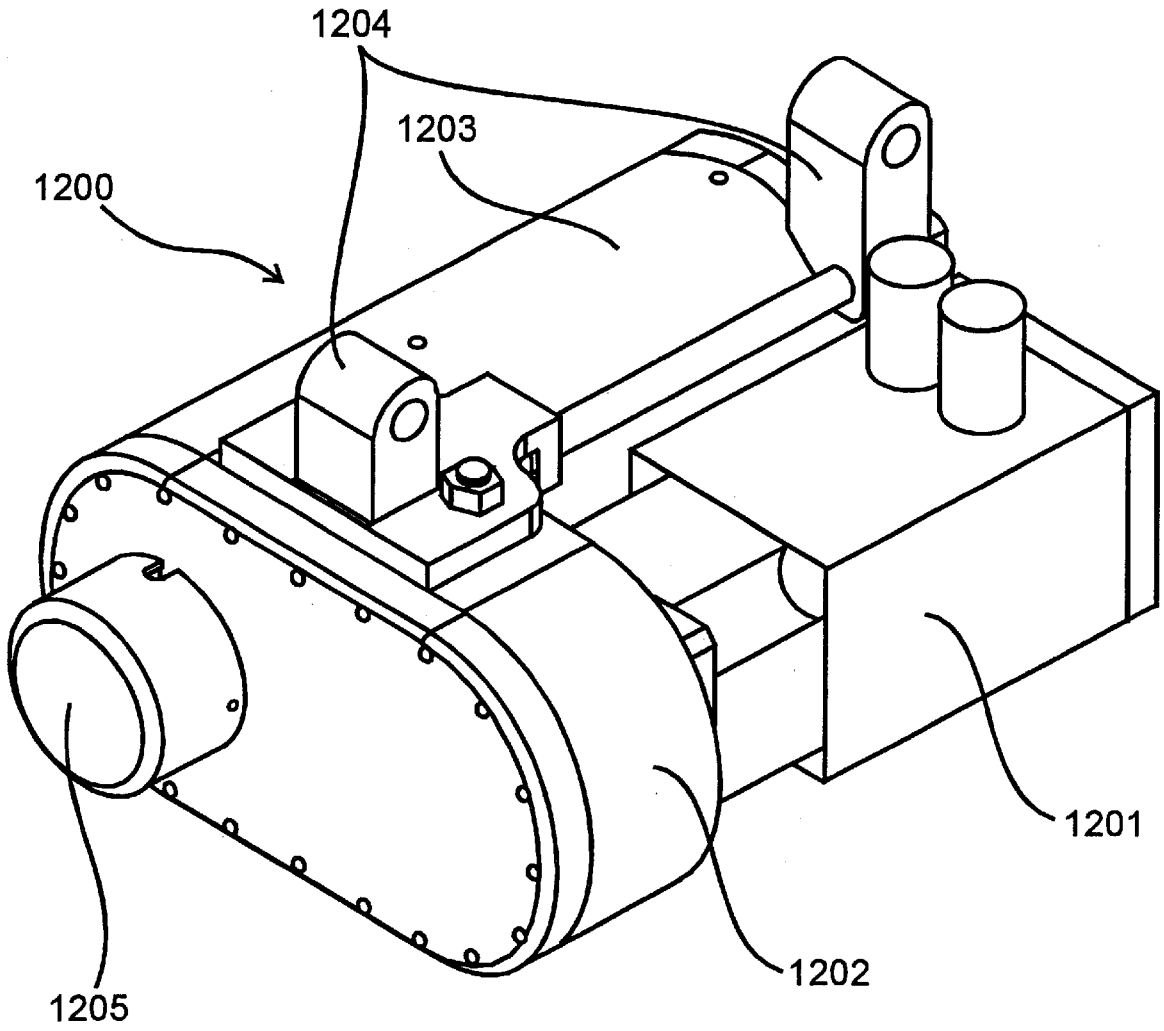
FIG. 12 shows the overall configuration of the main components of the exemplary hoist: motor, transmission, and reel assembly.
Figure 13:
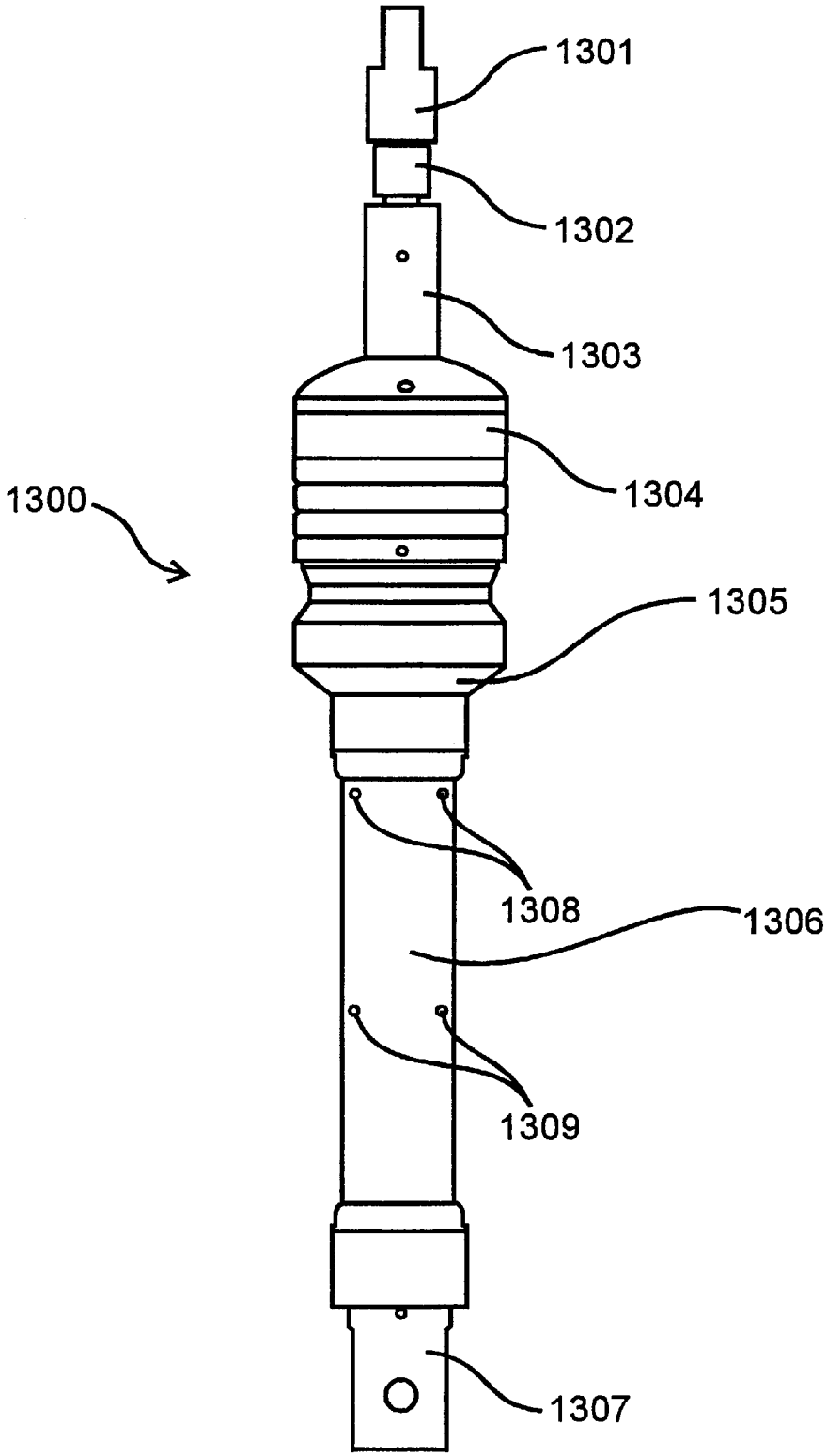
FIG. 13 shows an exemplary operator's handle.

Referring now to FIG. 12, shown is a view of an exemplary hoist body 1200. FIG. 13 shows the operator's control handle 1300 that can be used with the hoist of FIG. 12. The handle 1300 (FIG. 13) is to be attached to the end of a cable which is moved up and down by rotation of a reel 1601 (FIG 16) inside the hoist body 1200 (FIG. 12). The hoist body 1200 is affixed to a supporting structure by use of the ears 1204. A payload is attached by an attachment means to the lower end of the handle 1300.

The hoist body 1200 consists of primarily three subcomponents which are shown in the FIG. 12: a motor 1201, a transmission enclosed in a transmission housing 1202, and a reel assembly 1203. The motor 1201 itself will not be described further as an off-the-shelf commercial motor unit can be utilized. Of course, the components could be arranged relative to one another in a variety of different ways. An encoder cover 1205 encloses an absolute rotation encoder which will be described later herein. FIG. 12, however, best shows its location.

FIG. 13 shows an overview of the operator's handle 1300 that can be used to manipulate the payload up and down. An upper attachment point 1301 connects to the cable which is raised or lowered by the hoist body shown in FIG. 12. A load cell 1302 built into the handle 1300 in this embodiment measures the total force being lifted by the hoist. A hollow shaft 1303 connects through the handle to lower attachment point 1307, to which a payload may be connected. An operator's sleeve 1306 is movable axially on shaft 1303, thus giving a command to the hoist to move up or down. Sleeve 1306 is also free to rotate about shaft 1303. Slap-cap 1304 is also movable axially on shaft 1303, moving independently of operator's sleeve 1306. Motion of slap-cap 1304 actuates an emergency-stop switch. Flange 1305 is rigidly fixed to shaft 1303, and merely forms an attractive transition between the diameters of slap-cap 1304 and sleeve 1306.

First the reel assembly will be described, taking it apart and showing exploded views in successive Figures. Then the operator's handle will be described, taking it apart in successive Figures.

Figure 14:
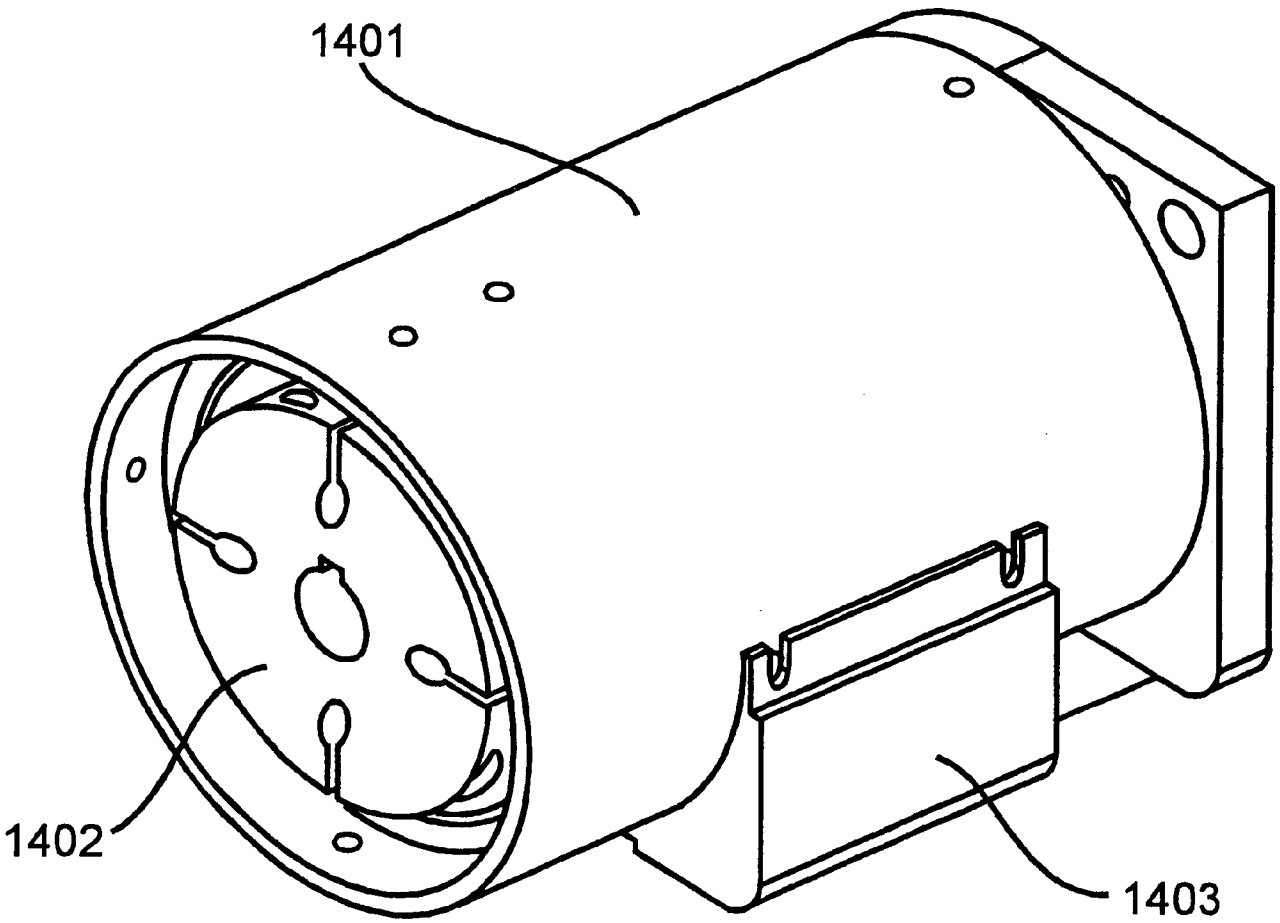
FIG. 14 shows an exemplary reel assembly of the hoist of FIG. 12.

FIG. 14 shows an overview of the reel assembly 1203 of FIG. 12, as removed from the hoist body 1200. The red assembly 1203 consists of an outer casing 1401 within which the reel cage 1402 rotates. The outer casing 1401 has a cutout in it whereby the cable exits, passing through a cable guide 1403, shown. The cutout is hidden under the cable guide 1403 and is not shown in FIG. 14.

Figure 15:
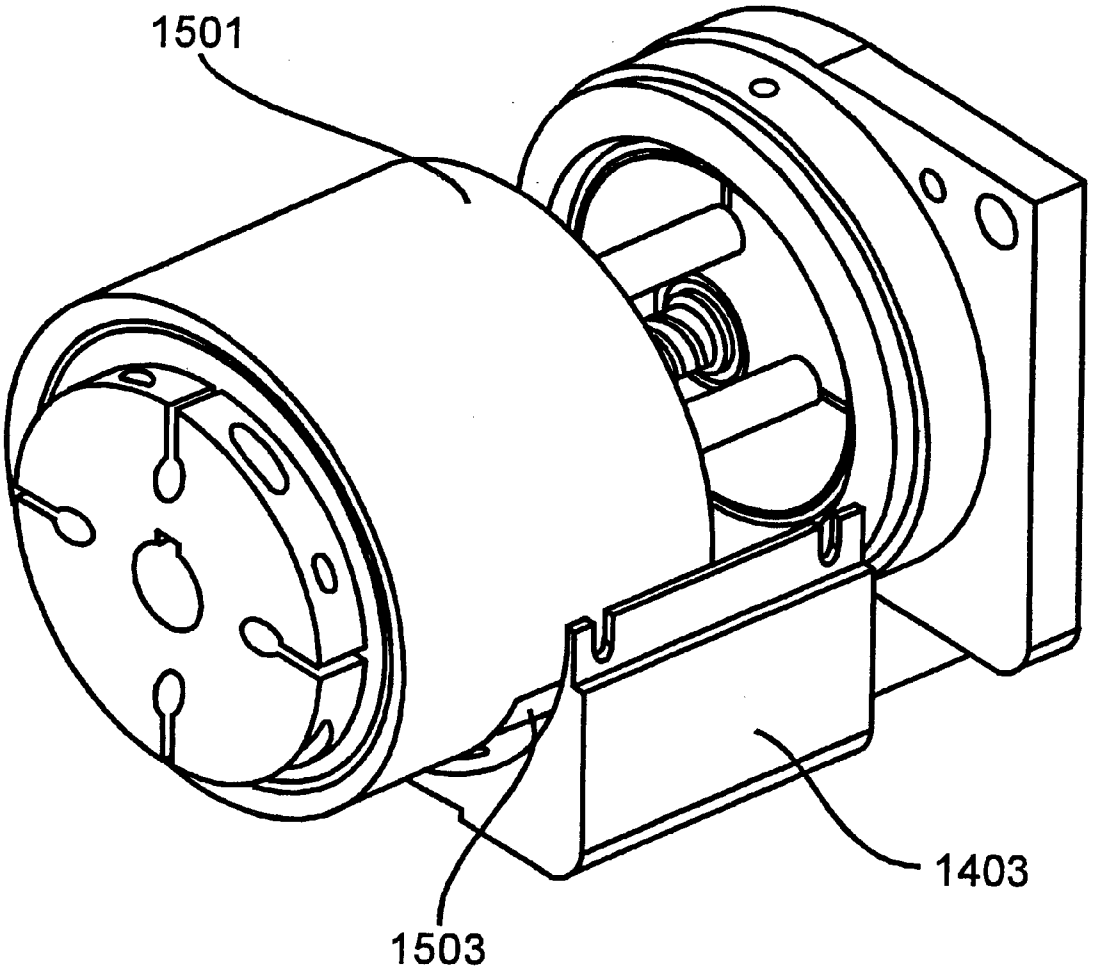
FIG. 15 shows the reel assembly of FIG. 14 with the outer housing removed.

Referring now to FIG. 15, inside the outer casing 1401, and also not rotatable, is the reel liner 1501. The purpose of the reel liner 1501 is to leave a little clearance above the multiple turns of cable on the reel 1601 (FIG. 16) within, so that the cable cannot overwrap itself and instead is confined to a helical track in the reel. The reel liner 1501 also has a cutout 1502 whereby the cable can exit the reel within. In this figure, the cutout 1502 is visible under the cable guide 1403.

Figure 16:
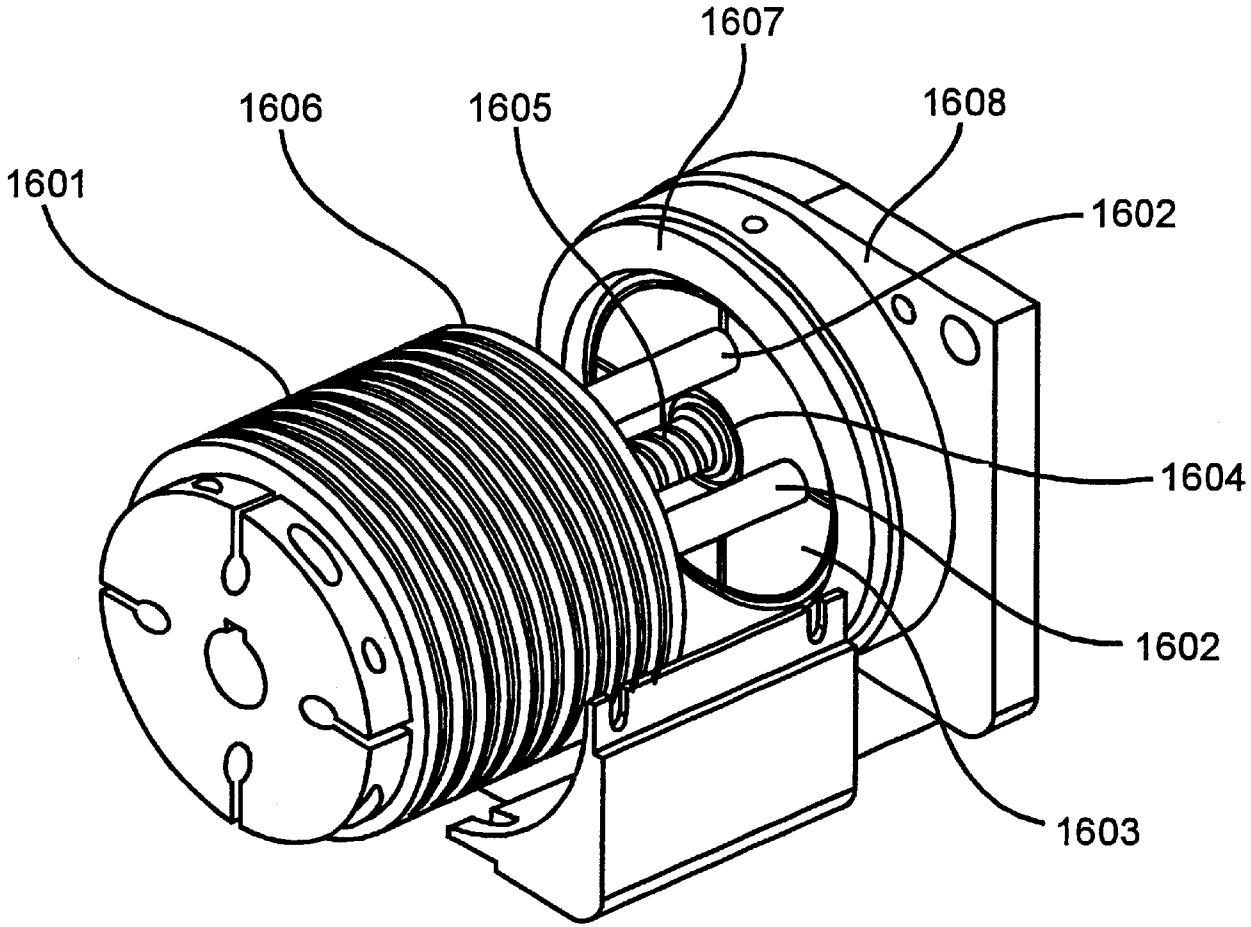
FIG. 16 shows the reel assembly of FIG. 15 with the reel liner also removed, emphasizing the reel and drive rods.

FIG. 16 shows reel assembly 1203 of FIG. 12 with both the reel liner 1501 shown in FIG. 15 and the outer casing removed. The cable (not shown) is wrapped on a helical track on the reel 1601. The reel 1601 is free to slide on a plurality of drive rods 1602, as permitted by cylindrical bearings 1701 within reel 1601, through which the drive rods 1602 pass. The drive rods 1602 are rigidly attached to end-disks 1603 at both ends, thus forming a rigid cage which can be rotated around its own axis. Said cage comprises drive rods 1602 and end plates 1603. Said cage is connected by bearings 1604 to the reel assembly end-plates 1608, so that cage is able to rotate about its axis. As cage rotates, it forces reel 1601 to rotate. The cage is driven by electric motor 1201 via a transmission which will be shown later.

The reel 1601 also preferably contains a ball-nut rigidly fixed within it (not visible) which engages a ball-screw 1605. The ball screw is rigidly attached to the end-plate 1608 of the reel assembly. Thus, as the reel 1601 is rotated by rotation of the cage, it is also caused to translate along the ball screw 1605. The pitch of the ball-screw 1605 and the pitch of the helical track in the reel 1601 are the same, so that the exit point of the cable from the helical track stays fixed as reel 1601 rotates.

At either end of reel 1601 is a reel end plate 1606 rigidly affixed to the reel. If the reel should reach the extreme end of its travel along the ball screw, the reel end plate 1606 comes into contact with a felt annulus 1607 which is affixed to the assembly end plate 1608 to limit the travel of the reel end plate 1606.

Figure 17:
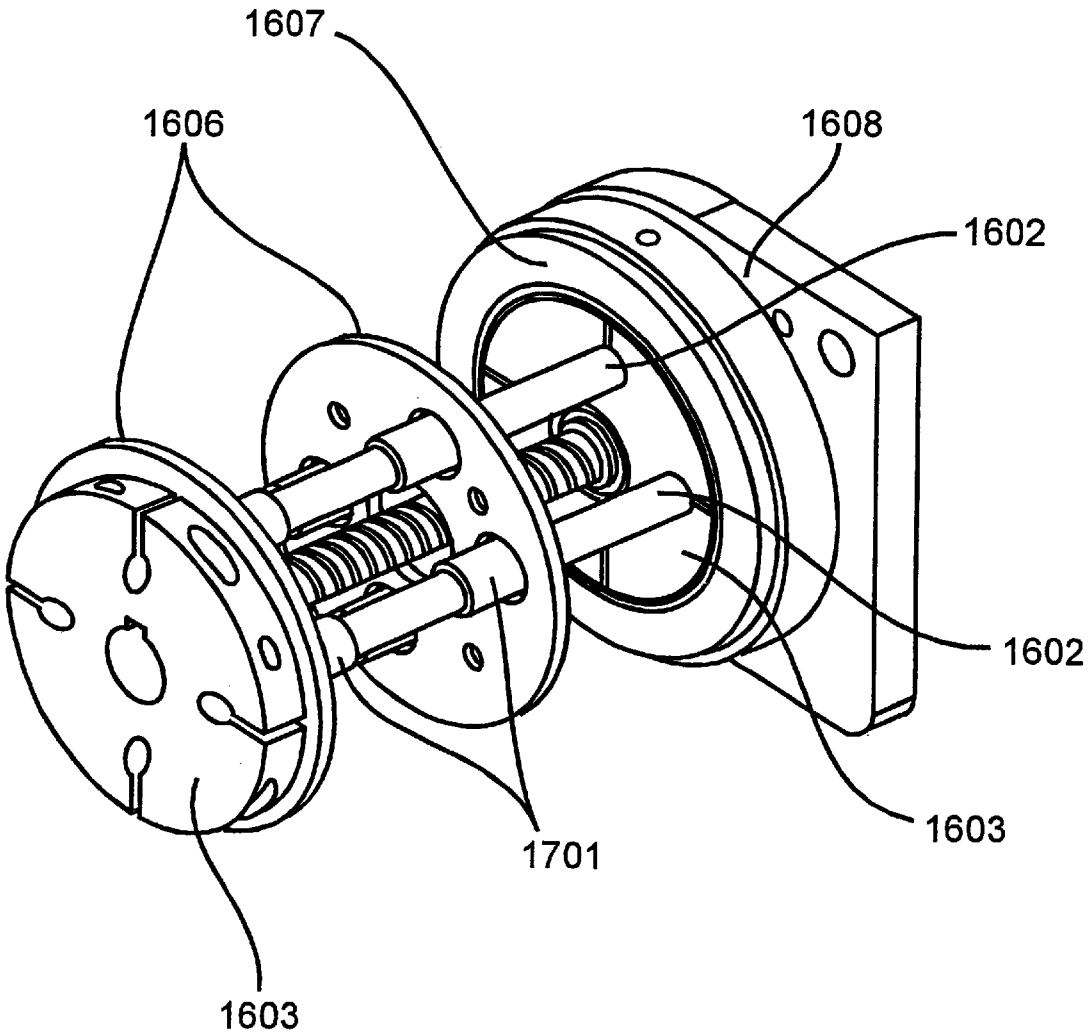
FIG. 17 shows the reel assembly of FIG. 16 with the reel also removed, emphasizing the bearings and ball screw.

FIG. 17 shows the reel assembly with the reel 1601 removed, leaving however the reel end plates 1606 visible. No new parts are introduced in this figure but some are seen more clearly. FIG. 17 shows the assembly end plate 1608, to which the felt annulus 1607 is affixed. Drive rods 1602 pass through cylindrical bearings 1701, together with end-disks 1603 forming the rotating cage 1602. Rotation of the cage 1602 causes the reel 1601 to translate along the ball-screw 1605. At the end of travel reel end plates 1606 will collide with felt annulus 1607 to limit its travel.

Figure 18:
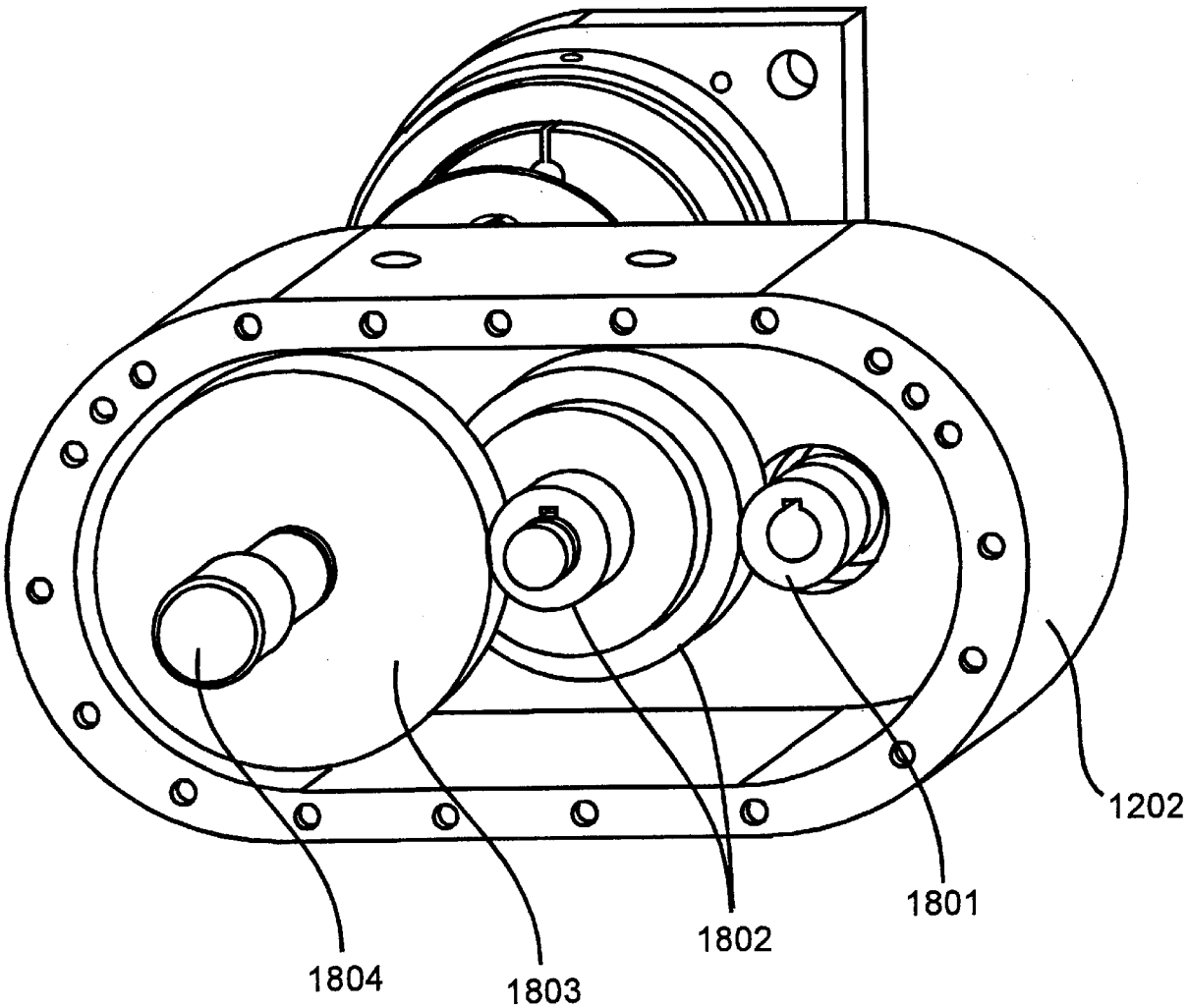
FIG. 18 shows the transmission of the hoist of FIG. 12.

FIG. 18 shows the transmission enclosure 1202 (FIG. 12) with its cover removed. The motor 1201 (FIG. 12) drives the pinion gear 1801. Pinion gear 1801 drives the larger diameter of gear 1802 while the smaller diameter of gear 1802 drives gear 1803. Gear 1803 drives the end disk 1603 of cage 1602 and thus rotates the reel 1601. Gear 1803 also rotates an absolute rotation encoder 1804 so that the height of the payload may be deduced.

Figure 19:
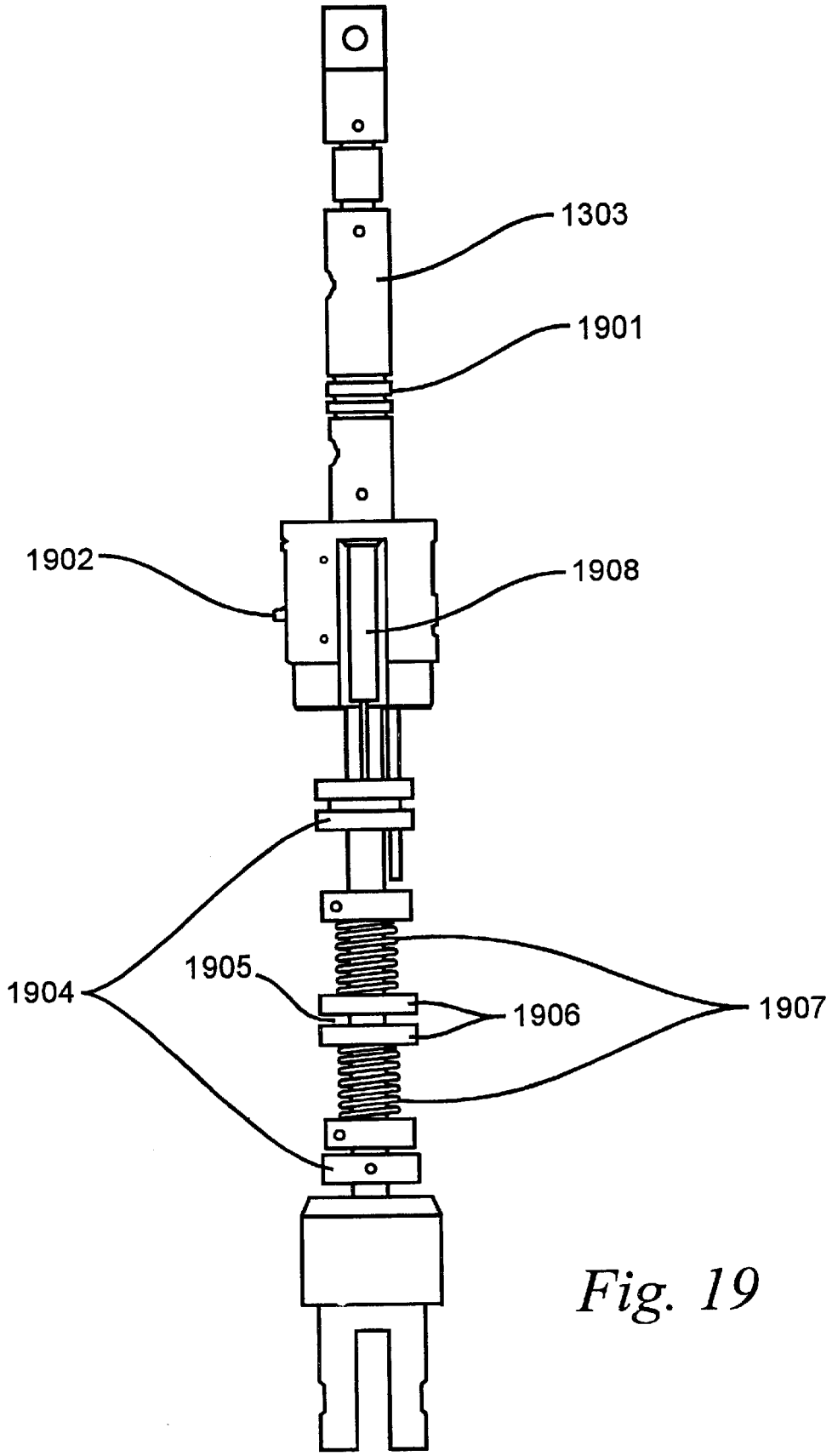
FIG. 19 shows the operator's handle of FIG. 13 with outer covers and sleeves removed.

FIG. 19 shows the operator's handle of FIG. 13 with the slap cap 1304, flange 1305, and sleeve 1306 removed to show the internal details. Shaft 1303 may be seen to include detents 1901 which cause slap-cap 1304 to snap into a plurality of preferred positions. These positions include one or more predetermined positions which allow hoist operation and one or more positions which prevent hoist operation, as controlled by a switch 1902 which reads the position of slap-cap 1304. In one particular embodiment, three detent positions are provided. The central detent position allows hoist motion and the outer two position prevents hoist operation. Thus, the hoist can be shut off with a force either up or down on the slap cap 1304. In another embodiment there are only two detent positions, so that the hoist may operate when the slap cap 1304 is in the upper detent position and is shut down when the slap cap 1304 is in the lower detent position.

FIG. 19 also shows the parts necessary for operation of the sleeve 1306, which is moved by the operator to request LIP or down motion of the payload. Sleeve 1306 is attached via dowel pins 1308 to sliders 1904 which slide on shaft 1303. Further dowel pins 1309 pass through slot 1905 between disks 1906. Thus, when the sleeve 1306 is moved upward the upper of the disks 1906 is raised, and when the sleeve 1306 is moved downward the lower of the two disks is lowered. When the upper of the disks 1906 is raised the upper of the springs 1907 is compressed but the lower of the springs 1907 is not compressed or extended. When the lower of the disks 1906 is lowered, the lower of the springs 1907 is compressed but the upper spring is not compressed or extended. Thus, the motion of the sleeve 1306 is initially opposed for either motion up or down, by the preload of the springs 1907. Once the operator has applied sufficient force to overcome the preload, the sleeve 1306 may move up or down, compressing one or the other of the springs 1907.

Axial motion of the sleeve 1306 carries with it motion of the sliders 1904, and in particular motion of the upper of these sliders. Motion of the slider is conveyed to a damper or dashpot 1908, and also to a linear potentiometer positioned opposite dashpot 1908 behind shaft 1303. Thus, the displacement of the sleeve 1306 from its central null position can be monitored by the potentiometer, and its motion is impeded by the action of the dashpot 1908. Of course, the action of the dashpot can be accomplished in many different ways, such as the use of eddy current damping, viscous damping, a pneumatic dashpot, or mechanical friction.

The exemplary embodiments provide many advantages in providing an improved hoist that is agile and pleasing for an operator to use. The improved hoist allows both a handle control mode and a float control mode. The handle control mode is highly responsive, allowing quick and accurate payload motion in response to relatively insignificant efforts on the part of the operator. By virtue of the handle-nulling controller, if the operator wishes the payload to rise by a small amount $\Delta z$ he simply lifts the handle by that amount $\Delta z$ and the payload quickly follows.

The float mode allows the operator to apply forces directly to the payload itself, without requiring use of the handle. Float mode is especially desirable in situations when the operator needs to manipulate the payload manually in other degrees of freedom, in addition to having the hoist's assistance in the vertical direction. In this situation, the operator may not wish to necessarily restrict one hand to grasp a handle, leaving hands free to maneuver the payload. The float mode is highly responsive and intuitive because it requires only a narrow dead-band, and only small forces from the operator.

In an exemplary embodiment, small forces applied by the operator can be distinguished by the controller from the payload's weight and from its inertial forces when accelerating. Thus the hoist can respond to small operator forces without an annoyingly wide dead-band. Further, the small dead-band does not depend on having low-friction inherently in the hoist mechanism, as do prior art balancers. Eliminating the requirement of low friction in the system makes possible the more efficient use of motors and the use of higher transmission ratios, both of which offer considerable cost savings.

Another advantage is that the handle mode and float mode are available at once in a single hoist, with transparent switching between different hoist operation modes and features, as made possible by the mode switching algorithm described herein.

A further advantage is that the mass estimation algorithm operates accurately even when the payload is moving or accelerating. This makes it possible to determine the payload's mass, as a scale might, without requiring a settling time.

The embodiments of the mechanical aspects of the hoist also provide many advantages. The dashpot in the handle provides damping and improves the stability of the control system against unwanted oscillations. A more responsive control system is thus possible because gains may be increased without incurring oscillations. Another advantage is the integration of the slap-cap emergency stop switch into the operator's handle, which makes it possible for the operator to quickly locate the switch in any circumstance.

Another advantage is the use of a light duty ball screw, since its function is used only to translate the reel rather than to cause it to rotate as in prior art. The ball screw serves to move the reel such that the exit point of the cable from the helical track on the reel occurs always at the same point relative to the hoist body. Thus the cable and the payload suspended from it does not wander as the payload is moved up and down.

Another advantage is the use of a felt annulus as a brake to prevent further motion of the reel if its motion exceeds the normal limits for some reason. In this event, if the reel were to collide with the fixed end plates in the absence of felt annuli, very large forces would develop, which could damage the ball screw or the reel, and would cause irreversible jamming. The felt annuli are importantly somewhat compressible, allowing an interval of reel displacement during which the reel comes to rest, as opposed to a hard and sudden collision in the absence of the felt annuli. Further, the compressed felt annulus produces a braking torque on the reel which contributes more to its stopping than does the linear collision force. It is only the latter which must be supported by the ball screw, and thus a light-duty ball screw may be used without fear of damage.

Another advantage is the use of a multi-turn potentiometer to measure the absolute angular displacement of the reel over its many turns, thus making possible an absolute measurement of payload height without need of an index.

It should be understood that the programs, processes, methods, systems and apparatus described herein are not related or limited to any particular type of computer apparatus (hardware or software), unless indicated otherwise. Various types of general purpose or specialized computer apparatus may be used with or perform operations in accordance with the teachings described herein.

In view of the wide variety of embodiments to which the principles of the invention can be applied, it should be understood that the illustrated embodiments are exemplary only, and should not be taken as limiting the scope of the present invention. In addition, the present invention can be practiced with software, hardware, or a combination thereof.

The claims should not be read as limited to the described order or elements unless stated to that effect. Therefore, all embodiments that come within the scope and spirit of the following claims and equivalents thereto are claimed as the invention.

We claim:

1. A method of dynamically determining a mass of a moving payload, the method comprising:

measuring an effective payload weight;

measuring an effective payload vertical acceleration;

reading an input control signal, wherein the input control signal is originated from a control handle to manipulate the payload;

comparing the input control signal to a threshold signal, wherein the threshold signal comprises a limit of a dead-band of the control handle;

updating an estimated mass of the payload if the input control signal exceeds the threshold signal; and correcting for the acceleration of the payload to determine the mass of the payload.

2. The method of claim 1, wherein the step of measuring an effective payload weight comprises:

reading a reel torque; and converting the reel torque to the effective payload weight.

3. The method of claim 1, wherein the step of measuring an effective payload weight comprises:

reading a payload load cell signal; and converting the payload load cell signal to the effective payload weight.

4. The method of claim 1, wherein the step of measuring an effective payload weight comprises:

reading a motor current;

converting the motor current to the effective payload weight.

5. The method of claim 1 further comprising:

filtering the input control signal for random noise or spurious signals.

6. A method of dynamically determining a mass of a moving payload suspended from a support and manipulated by a control handle, the method comprising:

measuring an effective payload weight;

measuring an effective payload vertical acceleration;

receiving an input control signal from the control handle;

comparing the input control signal to a threshold signal, wherein the threshold signal comprises a limit of a dead-band of the control handle;

updating an estimated mass of the payload if the input control signal exceeds the threshold signal; and correcting for the acceleration of the payload to determine the mass of the payload.

7. A method of dynamically determining the mass of a moving payload, the method comprising:

measuring an effective payload weight;

measuring an effective payload vertical acceleration;

reading an input control signal, wherein the input control signal is originated from a control handle to manipulate the payload;

generating a signal in response to comparing the input control signal to a threshold signal, wherein the threshold signal comprises a limit of a dead-band of the control handle;

updating an estimated mass of the payload if the input control signal exceeds the threshold signal; and correcting for the acceleration of the payload to determine the mass of the payload.

* * * * *